US010044145B2

(12) United States Patent
Kondo

(10) Patent No.: US 10,044,145 B2
(45) Date of Patent: Aug. 7, 2018

(54) CONNECTOR AND METHOD OF MANUFACTURING CONNECTOR

(71) Applicant: HOSIDEN CORPORATION, Yao-shi (JP)

(72) Inventor: Hayato Kondo, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 78 days.

(21) Appl. No.: 14/824,322

(22) Filed: Aug. 12, 2015

(65) Prior Publication Data

US 2016/0056580 A1 Feb. 25, 2016

(30) Foreign Application Priority Data

Aug. 19, 2014 (JP) ..... 2014-166873

(51) Int. Cl.
*H01R 13/6473* (2011.01)
*H01R 13/405* (2006.01)
*H01R 43/24* (2006.01)

(52) U.S. Cl.
CPC ..... *H01R 13/6473* (2013.01); *H01R 13/405* (2013.01); *H01R 43/24* (2013.01)

(58) Field of Classification Search
CPC ... H01R 13/405; H01R 13/6473; H01R 43/24
USPC ..... 439/626, 941
See application file for complete search history.

(56) References Cited

U.S. PATENT DOCUMENTS 5,795,191 A * 8/1998 Preputnick ..... H01R 23/688 439/108
6,786,755 B2 * 9/2004 Dambach ..... H01R 13/6273 439/353
7,462,924 B2 * 12/2008 Shuey ..... H01R 13/6471 257/666

(Continued)

FOREIGN PATENT DOCUMENTS

JP 2002-175853 A 6/2002
JP 2009-66858 A 4/2009
JP 2012-252904 A1 12/2012

OTHER PUBLICATIONS

Notification of Reasons for Refusal for counterpart Japanese Patent Application No. 2014-166873 dated Dec. 5, 2017 (3 Sheets, 4 Sheets translation, 7 Sheets total).

*Primary Examiner* — Michael A Lyons
*Assistant Examiner* — Milagros Jeancharles
(74) *Attorney, Agent, or Firm* — Kratz, Quintos & Hanson, LLP

(57) ABSTRACT

A connector including a pair of first terminals, a second terminal, a third terminal, and a body. The first terminals are differential signal terminals in spaced juxtaposition to each other. The second terminal is located on one side relative to and in spaced relation to one of the first terminals. The third terminal is located on the other side relative to and in spaced relation to the other first terminal. The body holds the terminals at least partially. The body includes a first portion between the first terminals, a second portion between the one first terminal and the second terminal, and a third portion between the other first terminal and the third terminal. The second portion has a second void, which extends from the one first terminal to the second terminal. The third portion has a third void, which extends from the other first terminal to the third terminal.

10 Claims, 12 Drawing Sheets

(56) References Cited

U.S. PATENT DOCUMENTS 7,645,146 B2 * 1/2010 Lindkamp ..... H01R 12/721 439/79
7,833,026 B1 * 11/2010 Morgan ..... H01R 12/52 439/108
8,342,888 B2 * 1/2013 Amleshi ..... H01R 13/514 439/660
8,597,036 B2 * 12/2013 Fogg ..... H01R 12/724 439/101
8,715,003 B2 * 5/2014 Buck ..... H01R 12/73 439/607.07
8,771,016 B2 * 7/2014 Atkinson ..... H01R 13/6474 439/607.07
9,252,541 B2 * 2/2016 Kumamoto ..... H01R 13/6581
9,277,649 B2 * 3/2016 Ellison ..... H01R 12/523
9,379,499 B2 * 6/2016 Miyoshi ..... H01R 24/60
2006/0084301 A1 * 4/2006 Fromm ..... H01R 13/514 439/101
2007/0293063 A1 * 12/2007 Droesbeke ..... H01R 13/6587 439/108
2008/0085618 A1 * 4/2008 Sercu ..... H01R 13/6586 439/108
2008/0214029 A1 * 9/2008 Lemke ..... H01R 13/6471 439/108
2009/0017682 A1 * 1/2009 Amleshi ..... H01R 13/6471 439/607.05
2010/0291803 A1 * 11/2010 Kirk ..... H01R 23/688 439/660
2011/0117781 A1 * 5/2011 Stoner ..... H01R 13/6587 439/607.01
2011/0212632 A1 * 9/2011 Stokoe ..... H01R 23/688 439/83
2011/0223810 A1 * 9/2011 Regnier ..... H01R 9/038 439/626
2013/0012038 A1 * 1/2013 Kirk ..... H01R 12/724 439/55
2013/0130554 A1 * 5/2013 Girard ..... H01R 13/6587 439/626
2013/0217263 A1 * 8/2013 Pan ..... H01R 13/6474 439/607.07
2014/0242844 A1 * 8/2014 Wanha ..... H01R 13/516 439/626
2014/0273663 A1 * 9/2014 Cartier, Jr. ..... H01R 43/16 439/692
2014/0302718 A1 * 10/2014 Gailus ..... H01R 13/6608 439/620.21
2015/0024635 A1 * 1/2015 McClellan ..... H01R 12/71 439/629

* cited by examiner

CONNECTOR AND METHOD OF MANUFACTURING CONNECTOR

CROSS-REFERENCE TO RELATED APPLICATIONS

The present application claims priority under 35 U.S.C. § 119 of Japanese Patent Application No. 2014-166873 filed on Aug. 19, 2014, the disclosure of which is expressly incorporated by reference herein in its entity.

BACKGROUND OF THE INVENTION

Technical Field

The invention relates to connectors and methods of manufacturing the connectors.

Background Art

JP 2012-252904 A describes a conventional connector. The connector includes a body of insulating plastic material and a plurality of terminals partially held in the body. The terminals includes a pair of differential signal terminals having different line lengths, a first adjacent terminal disposed next to one of the differential signal terminals, and a second adjacent terminal disposed next to the other differential signal terminal. The difference in line length between the differential signal terminals is a factor in delay of a signal transmitted through the one differential signal terminal compared to a signal transmitted through the other differential signal terminal. A part of the one differential signal terminal is surrounded by a recess in the body, which partially exposes the one differential signal terminal. The recess serves to adjust the amount of the plastic material of the body around the one differential signal terminal, lower the dielectric constant of substances around the one differential signal terminal, and reduce the possibility of delay of the signal transmitted through the one differential signal terminal.

SUMMARY OF INVENTION

Generally speaking, such a connector exhibits relatively low impedances at portions of differential signal terminals held in a body. On the other hand, there is a demand to array terminals at small pitches. When the terminals are arrayed at small pitches to meet this demand, the pair of differential signal terminals decreases in impedance under the influence of the adjacent terminals. These factors make it difficult to achieve matched impedances of the differential signal terminals.

In the conventional connector, the recess is provided only around a part of the one differential signal terminal in order to resolve the signal delay as discussed above. This arrangement should cause increase of impedance only at the part of the one differential signal terminal. Hence, when the terminals of the conventional connector are arrayed at small pitches, it becomes more difficult to achieve matched impedances between the differential signal terminals.

In the above circumstances, the invention provides a connector capable of readily matching impedances of a pair of differential signal terminals even if terminals are arrayed at a small pitch. The invention also provides a method of manufacturing the connector.

A connector of an aspect of the invention includes a pair of first terminals, a second terminal, a third terminal, a body of an insulating plastic material. The first terminals are differential signal terminals in spaced juxtaposition to each other in a first direction such as to extend in a direction including a component of a second direction, the second direction crossing the first direction. The first terminals include one first terminal and the other first terminal. The second terminal is a terminal not serving as a differential signal terminal and extends in a direction including a component of the second direction such as to be located on one side in the first direction relative to and in spaced relation to the one first terminal. The third terminal is a terminal not serving as a differential signal terminal and extends in a direction including a component of the second direction such as to be located on the other side in the first direction relative to and in spaced relation to the other first terminal. The body holds the first, second, and third terminals at least partially. The body includes a first portion between the first terminals, a second portion between the one first terminal and the second terminal, and a third portion between the other first terminal and the third terminal. The second portion has a second void in at least a portion thereof. The second void extends from the one first terminal to the second terminal. The third portion has a third void in at least a portion thereof. The third void extends from the other first terminal to the third terminal.

In the connector of this aspect, it is easy to match impedances between the first terminals even when the first terminals, the second terminal, and the third terminal are arrayed at small pitches for the following reasons. The first portion of plastic material exists between the one and the other first terminals, while at least a part of the second portion between the one first terminal and the second terminal is provided with the second void extending from the one first terminal to the second terminal, and at least a part of the third portion between the other first terminal and the third terminal is provided with the third void extending from the other first terminal to the third terminal. This arrangement weakens the electrical couplings between the one first terminal and the second terminal and between the other first terminal and the third terminal and strengthens the differential coupling between the first terminals. This results in improved impedances of the portions of the first terminals held in the body, facilitating impedance matching between the first terminals.

The body may further include a first face on one side of a third direction, and a second face on the other side of the third direction. The third direction may cross the first direction and the second direction. At least one of the second void or the third void may open to at least one of the first face or the second face.

The connector of this aspect has the following technical features. First, it is easy to provide the body with the second void and/or the third void for the following reasons. At least one of the second void or the third void opens to at least one of the first face or the second face of the body. Accordingly, the at least one of the second void or the third void can be made using a protrusion or protrusions on at least one of first and second molds for molding the body. The protrusion or protrusions will be inserted between the one first terminal and the second terminal and/or between the other first terminal and the third terminal, and subsequently plastic material will be injected into a cavity of the first and second molds. This simple procedure allows the easy provision of the second void and/or the third void. Second, it is possible to reduce the possibility at the time of injection molding of the body that the flow of the plastic material may cause displacement or deformation of at least one of the first terminals, the second terminal, and the third terminal. This is because, as described above, the second void extends from the one first terminal to the second terminal, and the third void extends from the other first terminal to the third terminal. At the time of molding plastic material, the protrusion or protrusions is inserted between and into contact with the one first terminal and the second terminal, and/or inserted between and into contact with the other first terminal and the third terminal. Such contacts of the protrusion(s) can reduce the possibility of displacement or deformation of at least one of the first terminals, the second terminal, or the third terminal due to flow of the plastic material injected into the cavity.

Alternatively, the body may further include a first face on one side of a third direction and a first recess on the one side of the third direction relative to the second void of the body. The third direction may cross the first direction and the second direction. The first recess may communicate at least with the second void and open to the first face such that at least one of the one first terminal or the second terminal is partially exposed through the first recess to the outside of the body.

The connector of this aspect has at least the following technical features. First, it is easy to provide the body with the second void because the first recess opens to the first face and communicates at least with the second void. If one of first and second molds for molding the body of the connector is provided with a first retainer to form the first recess, the first retainer can be provided with a protrusion to make at least the second void. The second void can thus be readily made, simply by injecting plastic material into a cavity of the first and second molds with such a protrusion placed between the one first terminal and the second terminal. Second, it is possible to reduce the possibility at the time of injection molding of the body that the flow of the plastic material may cause displacement or deformation of the one first terminal and/or the second terminal. This is because, as described above, at least one of the one first terminal and the second terminal is partially exposed through the first recess to the outside of the body, and the second void extends from the one first terminal to the second terminal. At the time of plastic material molding, if the above-described first retainer is provided to be brought into contact with at least one of the one first terminal or the second terminal, the protrusion will be placed between and into contact with the one first terminal and the second terminal. Such contacts of the retainer and the protrusion can reduce the possibility of displacement or deformation of the one first terminal and/or the second terminal due to the flow of plastic material.

The body may further include a second face on the other side of the third direction, and a second recess on the other side of the third direction relative to the second void of the body. The second recess may communicate at least with the second void and open to the second face such that at least one of the one first terminal or the second terminal is partially exposed through the second recess to the outside of the body.

The connector of this aspect can further reduce the possibility at the time of injection molding of the body that the flow of the plastic material may cause displacement or deformation of at least one of the one first terminal or the second terminal due to the flow of plastic material for the following reasons. The second recess opens to the second face and communicates with at least the second void. If the other one of the first and second molds for molding the body of the connector is provided with a second retainer to form the second recess, the first or second retainer can be provided with a protrusion to make at least the second void. As described above, the one first terminal and/or the second terminal is partially exposed through the first and second recesses to the outside of the body, and the second void extends from the one first terminal to the second terminal. Accordingly, the first and second retainers will hold therebetween the one first terminal and/or the second terminal, and the protrusion will be placed between and into contact with the one first terminal and the second terminal. Such holding and contacts of the retainers and the protrusion can further reduce the possibility of displacement or deformation of the one first terminal and the second terminal due to the flow of plastic material.

The first portion may have a first void in at least a portion thereof. The connector of this aspect can further improve the impedance of the portions of the first terminals held in the body, further facilitating impedance matching between the first terminals.

A plurality of second voids may be provided, spaced from each other along a length direction of the second portion. A plurality of the third voids may be provided, spaced from each other along a length direction of the third portion.

In the connector of this aspect, the above arrangement further weakens the electrical couplings between the one first terminal and the second terminal and between the other first terminal and the third terminal and further strengthens the differential coupling between the first terminals. This results in improved impedances of the portions of the first terminals held in the body, facilitating impedance matching between the first terminals.

The second voids and the third voids may be in a staggered arrangement.

The second void or voids may be elongated such as to extend along the length direction of the second portion. The third void or voids may be elongated such as to extend along the length direction of the third portion.

In the connector of this aspect, the above arrangement further weakens the electrical couplings between the one first terminal and the second terminal and between the other first terminal and the third terminal and further strengthens the differential coupling between the first terminals. This results in improved impedances of the portions of the first terminals held in the body, facilitating impedance matching between the first terminals.

A method of manufacturing a connector of the invention includes closing a first mold and a second mold together such that a pair of first terminals, a second terminal, and a third terminal are housed at least partially inside a cavity of the first and second molds; and injecting plastic material into the cavity so as to insert the first, second, and third terminals at least partially into the plastic material. At least one of the first or second mold includes a second protrusion, and at least one of the first or second mold includes a third protrusion. The closing of the first and second molds includes: (1) placing the first terminals in spaced relation to each other along a first direction, the second terminal on one side of the first direction relative to and in spaced relation to one of the first terminals, and the third terminal on the other side of the first direction relative to and in spaced relation to the other first terminal; (2) placing the second protrusion between and in contact with the one first terminal and the second terminal in the cavity, and (3) placing the third protrusion between and in contact with the other first terminal and the third terminal in the cavity.

The manufacturing method of this aspect has at least the following technical features. First, the second protrusion makes it possible to readily form the second void between the one first terminal and the second terminal, and the third protrusion makes it possible to readily form the third void between the other first terminal and the third terminal.

Second, when plastic material is injected into the cavity, the flow of plastic material is unlikely to cause displacement or deformation of at least one of the one first terminal, the other first terminal, the second terminal, and the third terminal. This is because the second protrusion will be brought into contact with the one first terminal and the second terminal, and the third protrusion will be brought into contact with the other first terminal and the third terminal.

One of the first and second molds may include a retainer. The retainer may at least include the second protrusion. The closing of the first and second molds may further include holding at least one of the one first terminal or the second terminal between the retainer and the other of the first and second molds. Alternatively, the closing of the first and second molds may further include holding at least one of the one first terminal or the second terminal between the retainer of the one of the first and second molds and another retainer of the other one of the first and second molds.

The manufacturing method of this aspect can further reduce the possibility at the time of injecting plastic material into the cavity that the flow of the plastic material may cause displacement or deformation of at least one of the one first terminal and the second terminal.

One of the first and second molds may include a retainer. The retainer may at least include the second protrusion and the third protrusion. The closing of the first and second molds may further include holding the first, second, and third terminals between the retainer and the other of the first and second molds. Alternatively, the closing of the first and second molds may further include holding the first, second, and third terminals between the retainer of the one of the first and second molds and another retainer of the other one of the first and second molds.

The manufacturing method of this aspect can further reduce the possibility at the time of injecting plastic material into the cavity that the flow of the plastic material may cause displacement or deformation of the first terminals, the second terminal, and the third terminal.

At least one of the first or second mold may include a first protrusion. The closing of the first and second molds may further include placing the first protrusion between and in contact with the pair of first terminals in the cavity.

The manufacturing method of this aspect has at least the following technical features. First, the first protrusion makes it possible to readily form the first void in the plastic material between the first terminals. Second, it is possible to reduce the possibility at the time of injecting plastic material into the cavity that the flow of the plastic material may cause displacement or deformation of the first terminals. This is because the one first terminal will be contacted by the first and second protrusions, and the other first terminal will be contacted by the first and third protrusions.

In a case where a plurality of the second protrusions and a plurality of third protrusions is provided, the closing of the first and second molds may include placing the second protrusions between and in contact with the one first terminal and the second terminal in the cavity, and placing the third protrusions between and in contact with the other first terminal and the third terminal in the cavity.

The manufacturing method of this aspect has at least the following technical features. First, the plurality of second protrusions makes it possible to readily form a plurality of second voids in the plastic material between the one first terminal and the second terminal, and the plurality of third protrusions makes it possible to readily form a plurality of third voids in the plastic material between the other first terminal and the third terminal. Second, it is possible to further reduce the possibility at the time of injecting plastic material into the cavity that the flow of the plastic material may cause displacement or deformation of at least one of the first terminals, the second terminal or the third terminal. This is because the second protrusions will be brought into contact with the one first terminal and the second terminal, and the third protrusions will be brought into contact with the other first terminal and the third terminal.

The second protrusions and the third protrusions may be in a staggered arrangement.

The second protrusion or protrusions may be elongated, and the third protrusion or protrusions may be elongated.

DESCRIPTION OF EMBODIMENTS

The first and second embodiments of the invention will be described below.

First Embodiment

Figure 1:
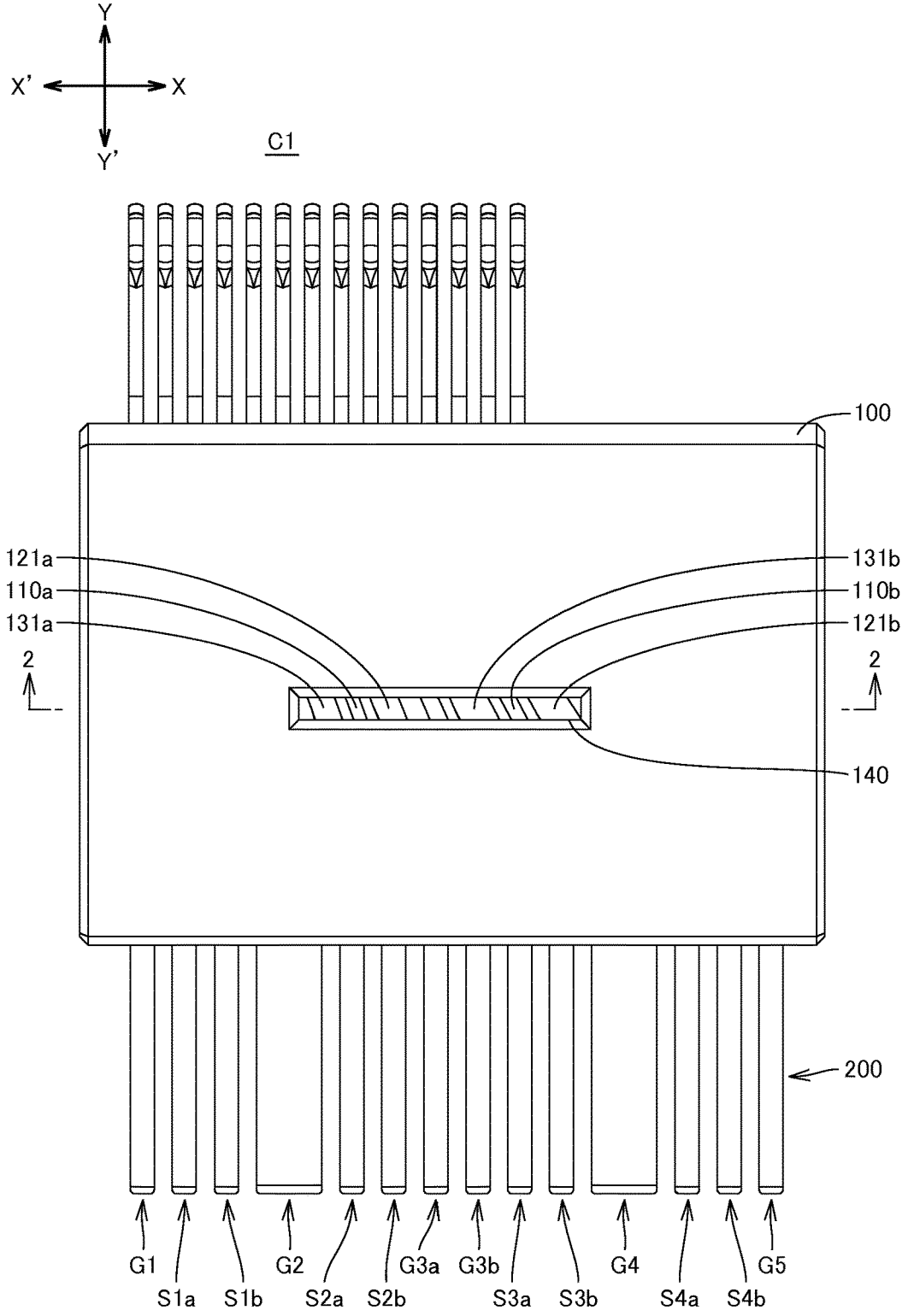
FIG. 1 is a plan view of a body and a terminal group of a connector in the first embodiment of the invention.
Figure 2:
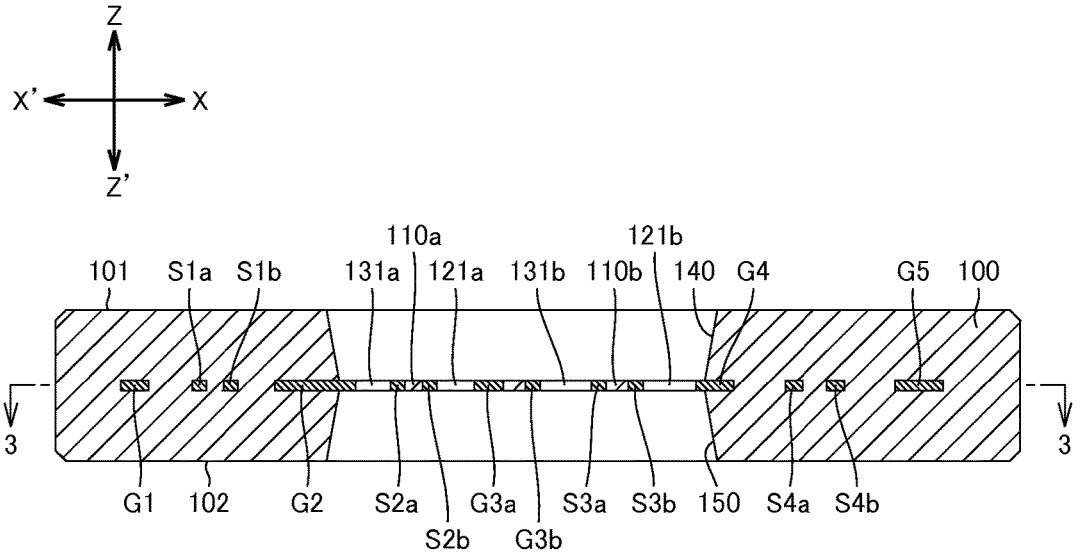
FIG. 2 is a sectional view of the body and the terminal group, taken along 2-2 in FIG. 1.
Figure 3:
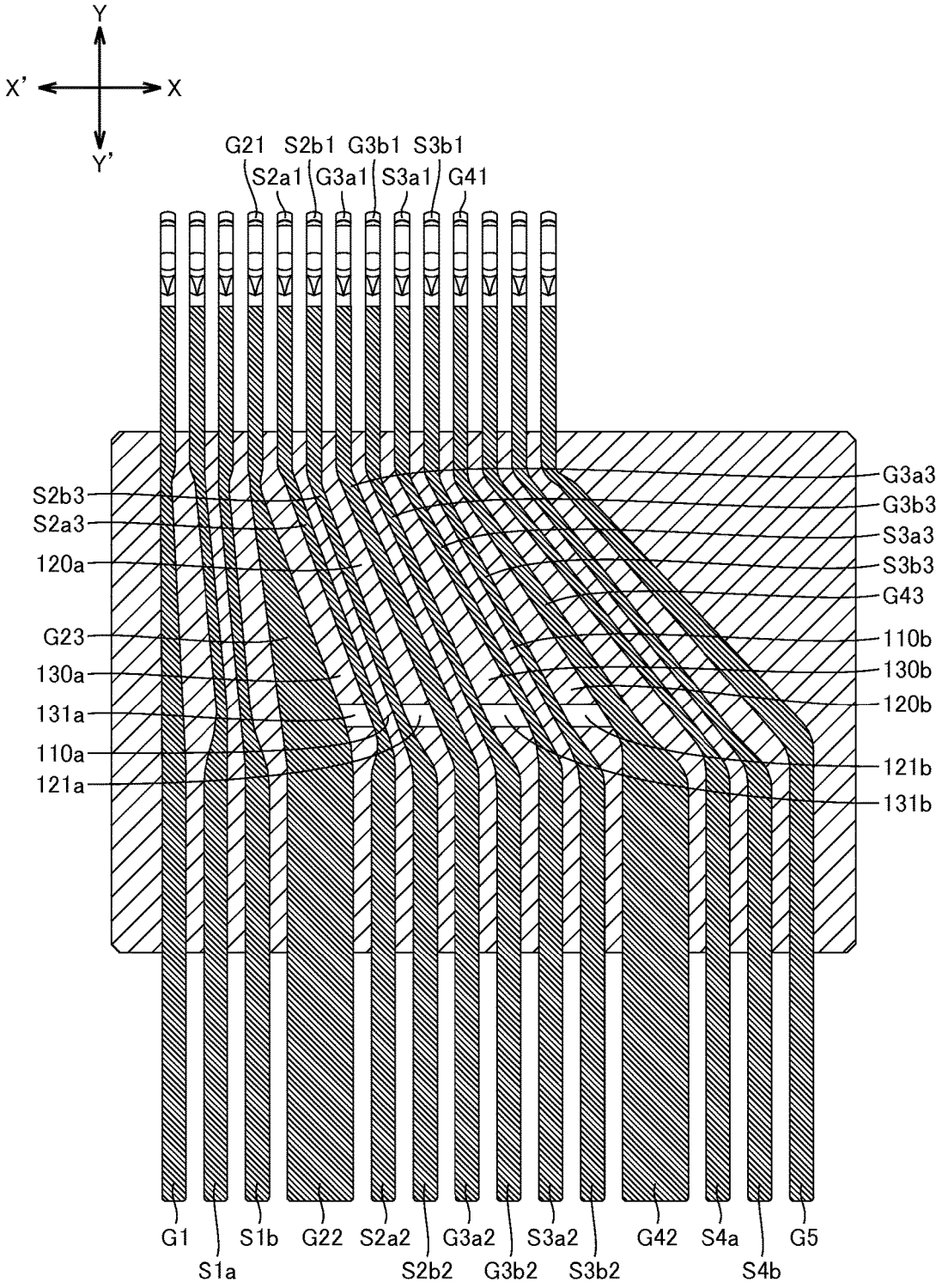
FIG. 3 is a sectional view of the body and the terminal group, taken along 3-3 in FIG. 2.

A connector C1 in the first embodiment of the invention will be described below with reference to FIG. 1 to FIG. 4. The connector C1 includes a case (not shown), a body 100, and a terminal group 200. It should be appreciated that the X-X' direction indicated in FIG. 1 to FIG. 3 is the array direction of the terminals 200 of the terminal group of the connector C1 and corresponds to the "first direction" set forth in the claims. Of the X-X' direction, the X direction corresponds to one side of the first direction, and the X' direction corresponds to the other side of the first direction. The Y-Y' direction indicated in FIGS. 1 and 3 is the longitudinal direction of each terminal of the terminal group 200 of the connector C1 and corresponds to the "second direction" set forth in the claims. The Y-Y' direction crosses the X-X' direction at right angles. Of the Y-Y' direction, the Y direction corresponds to one side of the second direction, and the Y' direction corresponds to the other side of the second direction. The Z-Z' direction indicated in FIG. 2 is the thickness direction of the body 100 of the connector C1 and corresponds to the "third direction" set forth in the claims. The Z-Z' direction crosses the Y-Y' and X-X' directions at right angles. Of the Z-Z' direction, the Z direction corresponds to one side of the third direction, and the Z' direction corresponds to the other side of the third direction.

The terminal group 200 includes terminals G1, S1*a*, S1*b*, G2, S2*a*, S2*b*, G3*a*, G3*b*, S3*a*, S3*b*, G4, S4*a*, S4*b*, and G5. The terminals of the terminal group 200 are partially held in the body 100 such as to be arranged at the same height (at a first height position) and in spaced relation to each other along the X-X' direction, in the order of G1, S1*a*, S1*b*, G2, S2*a*, S2*b*, G3*a*, G3*b*, S3*a*, S3*b*, G4, S4*a*, S4*b*, and G5. The body 100 and the terminal group 200 are housed in the case. A space in the case on the Y-direction side relative to the body 100 serves as a connection hole for connection with a mating connector.

The terminals S3*a* and S3*b* as illustrated in FIG. 1 to FIG. 3 are differential signal terminals in spaced juxtaposition to each other in the X-X' direction and extend in a direction including a component of the Y-Y' direction. The terminal S3*a* is located on the X'-direction side, and the terminal S3*b* is located on the X-direction side. The terminals S3*b* and S3*a* respectively correspond to one first terminal and the other first terminal set forth in the claims.

As best illustrated in FIG. 3, the terminal S3*a* includes a contact portion S3*a*1, a connecting portion S3*a*2, and a middle portion S3*a*3. The contact portion S3*a*1 extends in the Y-Y' direction. The contact portion S3*a*1 protrudes in the Y direction from the body 100 and is located inside the connection hole. The distal end of the contact portion S3*a*1 curves in the Z' direction.

The connecting portion S3*a*2 extends in the Y-Y' direction. The connecting portion S3*a*2 is located on the side of an oblique direction including the X- and Y'-direction components relative to the contact portion S3*a*1. The connecting portion S3*a*2 is located at the same height as the contact portion S3*a*1. The connecting portion S3*a*2 has a front portion and a rear portion. The front portion of the connecting portion S3*a*2 is a portion on the Y-direction side of the connecting portion S3*a*2 and is held in the body 100. In other words, the front portion of the connecting portion S3*a*2 is covered with the body 100 without any clearance therebetween. The rear portion, contiguous with the front portion, of the connecting portion S3*a*2, i.e. the Y'-direction side portion of the connecting portion S3*a*2, protrudes in the Y' direction from the body 100.

The middle portion S3*a*3 is provided between the contact portion S3*a*1 and the front portion of the connecting portion S3*a*2, contiguously connected between the contact portion S3*a*1 and the connecting portion S3*a*2, and held in the body 100. In other words, the middle portion S3*a*3 is covered with the body 100 without any clearance therebetween. The middle portion S3*a*3 extends (is inclined) from the contact portion S3*a*1 to the connecting portion S3*a*2 in an oblique direction including the X- and Y'-direction components.

The terminal S3*b* includes a contact portion S3*b*1, a connecting portion S3*b*2, and a middle portion S3*b*3. The contact portion S3*b*1 is similar in configuration to the contact portion S3*a*1. The contact portion S3*b*1 is located on the X-direction side relative to and in spaced relation to the contact portion S3*a*1 inside the connection hole.

The connecting portion S3*b*2 is similar in configuration to the connecting portion S3*a*2. The connecting portion S3*b*2 is disposed on the X-direction side relative to and in spaced relation to the connecting portion S3*a*2 such as to be located on the side of an oblique direction including the X- and the Y'-direction components relative to the contact portion S3*b*1. The connecting portion S3*b*2 is located at the same height as the contact portion S3*b*1.

The middle portion S3*b*3 is provided between the contact portion S3*b*1 and the front portion of the connecting portion S3*b*2, contiguously connected between the contact portion S3*b*1 and the connecting portion S3*b*2, and held in the body 100. In other words, the middle portion S3*b*3 is covered with the body 100 without any clearance therebetween. The middle portion S3*b*3 extends (is inclined) from the contact portion S3*b*1 to the connecting portion S3*b*2 in an oblique direction including the X- and the Y'-direction components. The middle portion S3*b*3 is disposed on the X-direction side relative to and in spaced relation to the middle portion S3*a*3. The inclination angle of the middle portion S3*b*3 relative to the contact portion S3*b*1 is the same as the inclination angle of the middle portion S3*a*3 relative to the contact portion S3*a*1.

As illustrated in FIG. 1 to FIG. 3, the terminal G4 extends in a direction including a component of the Y-Y' direction such as to be located between the terminal S3*b* and the terminal S4*a*. The terminal G4 is not a differential signal terminal, but may be a ground terminal, or may be a low-speed signal terminal adapted to transmit signals at a lower speed than signals transmitted through the terminals S3*a*, S3*b*, S4*a*, and S4*b*. More specifically, the low-speed signal terminal may be a single-end signal terminal, a power terminal, or a terminal of other functions, and may be adapted to transmit signals of frequency at most 1/10 or at most 1/100 of the frequency of signals transmitted through the terminals S3*a*, S3*b*, S4*a*, and S4*b*. The terminal G4 corresponds to a second terminal set forth in the claims.

As best illustrated in FIG. 3, the terminal G4 includes a contact portion G41, a connecting portion G42, and a middle portion G43. The contact portion G41 extends in the Y-Y' direction, protrudes in the Y direction from the body 100, and is located inside the connection hole. The contact portion G41 is located on the X-direction side relative to and in spaced relation to the contact portion S3*b*1 of the terminal S3*b*. The distal end of the contact portion G41 curves in the Z' direction.

The connecting portion G42 extends in the Y-Y' direction. The connecting portion G42 is disposed on the X-direction side relative to and in spaced relation to the connecting portion S3*b*2 of the terminal S3*b*. The connecting portion G42 is disposed on the side in an oblique direction including the X- and Y'-direction components relative to the contact portion G41. The connecting portion G42 is located at the same height as the contact portion G41. The connecting portion G42 has a front portion and a rear portion. The front portion of the connecting portion G42 is a portion on the Y-direction side of the connecting portion G42 and is held in the body 100. In other words, the front portion of the connecting portion G42 is covered with the body 100 without any clearance therebetween. The rear portion, contiguous with the front portion, of the connecting portion G42, i.e. the Y'-direction side portion of the connecting portion G42, protrudes in the Y' direction from the body 100.

The middle portion G43 is provided between the contact portion G41 and the front portion of the connecting portion G42, contiguously connected between the contact portion G41 and the connecting portion G42, and held in the body 100. In other words, the middle portion G43 is covered with the body 100 without any clearance therebetween. The middle portion G43 extends (is inclined) from the contact portion G41 to the connecting portion G42 in an oblique direction including the X- and Y'-direction components. The middle portion G43 is disposed on the X-direction side relative to and in spaced relation to the middle portion S3b3 of the terminal S3b.

As illustrated in FIG. 1 to FIG. 3, the terminal G3b extends in a direction including a component of the Y-Y' direction such as to be located on the X'-direction side relative to and in spaced relation to the terminal S3a. The terminal G3b is not a differential signal terminal, but may be a ground terminal, or may be a low-speed signal terminal adapted to transmit signals at a lower speed than signals transmitted through the terminals S3a, S3b, S2a, and S2b. More specifically, the low-speed signal terminal may be a single-end signal terminal, a power terminal, or a terminal of other functions, and may be adapted to transmit signals of frequency at most 1/10 or at most 1/100 of the frequency of signals transmitted through the terminals S3a, S3b, S2a, and S2b. The terminal G3b corresponds to a third terminal set forth in the claims.

As best illustrated in FIG. 3, the terminal G3b includes a contact portion G3b1, a connecting portion G3b2, and a middle portion G3b3. The contact portion G3b1 is similar in configuration to the contact portion G41 of the terminal G4. The contact portion G3b1 is located on the X'-direction side relative to and in spaced relation to the contact portion S3a1 of the terminal S3a.

The connecting portion G3b2 extends in the Y-Y' direction. The connecting portion G3b2 is located on the X'-direction side relative to and in spaced relation to the connecting portion S3a2 of the terminal S3a. The connecting portion G3b2 is located on the side of an oblique direction including the X- and Y'-direction components relative to the contact portion G3b1. The connecting portion G3b2 is located at the same height as the contact portion G3b1. The connecting portion G3b2 has a front portion and a rear portion. The front portion of the connecting portion G3b2 is a portion on the Y-direction side of the connecting portion G3b2 and is held in the body 100. In other words, the front portion of the connecting portion G3b2 is covered with the body 100 without any clearance therebetween. The rear portion, contiguous with the front portion, of the connecting portion G3b2, i.e. the Y'-direction side portion of the connecting portion S3a2, protrudes in the Y' direction from the body 100.

The middle portion G3b3 is provided between the contact portion G3b1 and the front portion of the connecting portion G3b2, contiguously connected between the contact portion G3b1 and the connecting portion G3b2, and held in the body 100. In other words, the middle portion G3b3 is covered with the body 100 without any clearance therebetween. The middle portion G3b3 extends (is inclined) from the contact portion G3b1 to the connecting portion G3b2 in an oblique direction including the X- and Y'-direction components. The middle portion G3b3 is located on the X'-direction side relative to and in spaced relation to the middle portion S3a3 of the terminal S3a.

As illustrated in FIG. 1 to FIG. 3, the terminal G3a extends in a direction including a component of the Y-Y' direction such as to be located between the terminal G3b and the terminal S2b, i.e. on the X-direction side relative to the terminal S2b. The terminal G3a is not a differential signal terminal, but may be a ground terminal, or may be a low-speed signal terminal adapted to transmit signals at a lower speed than signals transmitted through the terminals S3a, S3b, S2a, and S2b. More specifically, the low-speed signal terminal may be a single-end signal terminal, a power terminal, or a terminal of other functions, and may be adapted to transmit signals of frequency at most 1/10 or at most 1/100 of the frequency of signals transmitted through the terminals S3a, S3b, S2a, and S2b. The terminal G3a corresponds to a second terminal set forth in the claims.

As best illustrated in FIG. 3, the terminal G3a includes a contact portion G3a1, a connecting portion G3a2, and a middle portion G3a3. The contact portion G3a1 is similar in configuration to the contact portion G41 of the terminal G4 and is located on the X'-direction side relative to and in spaced relation to the contact portion G3b1 of the terminal G3b.

The connecting portion G3a2 is similar in configuration to the connecting portion G3b2 of the terminal G3b and is located on the X'-direction side relative to and in spaced relation to the connecting portion G3b2. The connecting portion G3a2 is located on the side of an oblique direction including the X- and Y'-direction components relative to the contact portion G3a1. The connecting portion G3a2 is located at the same height as the contact portion G3a1.

The middle portion G3a3 is provided between the contact portion G3a1 and the front portion of the connecting portion G3a2, contiguously connected between the contact portion G3a1 and the connecting portion G3a2, and held in the body 100. In other words, the middle portion G3a3 is covered with the body 100 without any clearance therebetween. The middle portion G3a3 extends (is inclined) from the contact portion G3a1 to the connecting portion G3a2 in an oblique direction including the X-Y'-direction components. The middle portion G3a3 is located on the X'-direction side relative to and in spaced relation to the middle portion G3b3 of the terminal G3b.

The terminals S2a and S2b as illustrated in FIG. 1 to FIG. 3 are differential signal terminals in spaced juxtaposition to each other in the X-X' direction and extend in a direction including a component of the Y-Y' direction. The terminal S2a is located on the X'-direction side, and the terminal S2b is located on the X-direction side. The terminals S2b and S2a respectively correspond to one first terminal and the other first terminal forth in the claims.

As best illustrated in FIG. 3, the terminal S2b includes a contact portion S2b1, a connecting portion S2b2, and a middle portion S2b3. The contact portion S2b1 is similar in configuration to the contact portion S3b1 and located on the X'-direction side relative to and in spaced relation to the contact portion G3a1 of the terminal G3a. The connecting portion S2b2 is similar in configuration to the connecting portion S3b2, and is disposed on the X'-direction side relative to and in spaced relation to the connecting portion G3a2 of the terminal G3a such as to be located on the side of an oblique direction including the X- and Y'-direction components relative to the contact portion S2b1. The connecting portion S2b2 is located at the same height as the contact portion S2b1.

The middle portion S2b3 is provided between the contact portion S2b1 and the front portion of the connecting portion S2b2, contiguously connected between the contact portion S2b1 and the connecting portion S2b2, and held in the body 100. In other words, the middle portion S2b3 is covered with the body 100 without any clearance therebetween. The middle portion S2b3 extends (is inclined) from the contact portion S2b1 to the connecting portion S2b2 in an oblique direction including the X- and Y'-direction components. The middle portion S2b3 is located on the X'-direction side relative to and in spaced relation to the middle portion G3a3 of the terminal G3a. The inclination angle of the middle portion S2*b*3 relative to the contact portion S2*b*1 is smaller than each inclination angle of the middle portions S3*a*3 and S3*b*3 relative to the contacts S3*a*1 and S3*b*1, respectively.

The terminal S2*a* includes a contact portion S2*a*1, a connecting portion S2*a*2, and a middle portion S2*a*3. The contact portion S2*a*1 is similar in configuration to the contact portion S3*a*1 of the terminal S3*a* and is located on the X'-direction side relative to and in spaced relation to the contact portion S2*b*1 of the terminal S2*b*. The connecting portion S2*a*2 is similar in configuration to the connecting portion S3*a*2 of the terminal S3*a*. The connecting portion S2*a*2 is disposed on the X'-direction side relative to and in spaced relation to the connecting portion S2*b*2 of the terminal S2*b* such as to be located on the side of an oblique direction including the X- and Y'-direction components relative to the contact portion S2*a*1. The connecting portion S2*a*2 is located at the same height as the contact portion S2*a*1.

The middle portion S2*a*3 is provided between the contact portion S2*a*1 and a front portion of the connecting portion S2*a*2, contiguously connected between the contact portion S2*a*1 and the connecting portion S2*a*2, and held in the body 100. In other words, the middle portion S2*a*3 is covered with the body 100 without any clearance therebetween. The middle portion S2*a*3 extends (is inclined) in an oblique direction including the X-direction component and the Y'-direction component from the contact portion S2*a*1 to the connecting portion S2*a*2. The middle portion S2*a*3 is disposed on the X'-direction side relative to and in spaced relation to the middle portion S2*b*3 of the terminal S2*b*. The inclination angle of the middle portion S2*b*3 relative to the contact portion S2*b*1 is the same as that of the middle portion S2*a*3 relative to the contact portion S2*a*1.

As illustrated in FIG. 1 to FIG. 3, the terminal G2 extends in a direction including a component of the Y-Y' direction such as to be located between the terminal S2*a* and the terminal S1*b*, i.e. on the X'-direction side relative to the terminal S2*a*. The terminal G2 is not a differential signal terminal, but may be a ground terminal, or may be a low-speed signal terminal adapted to transmit signals at a lower speed than signals transmitted through the terminals S1*a*, S1*b*, S2*a*, and S2*b*. More specifically, the low-speed signal terminal may be a single-end signal terminal, a power terminal, or a terminal of other functions, and may be adapted to transmit signals of frequency at most 1/10 or at most 1/100 of the frequency of signals transmitted through the terminals S1*a*, S1*b*, S2*a*, and S2*b*. The terminal G2 corresponds to a third terminal set forth in the claims.

As best illustrated in FIG. 3, the terminal G2 includes a contact portion G21, a connecting portion G22, and a middle portion G23. The contact portion G21 is similar in configuration to the contact portion G41 of the terminal G4. The contact portion G21 is disposed on the X'-direction side relative to and in spaced relation to the contact portion S2*a*1 of the terminal S2*a*.

The connecting portion G22 is similar in configuration to the connecting portion G42 of the terminal G4. The connecting portion G22 is located on the X'-direction side relative to and in spaced relation to the connecting portion S2*a*2 of the terminal S2*a* so as to be located on the side of an oblique direction including the X- and Y'-direction components relative to the contact portion G21. The connecting portion G22 is located at the same height as the contact portion G21.

The middle portion G23 is provided between the contact portion G21 and the front portion of the connecting portion G22, contiguously connected between the contact portion G21 and the connecting portion G22, and held in the body 100. In other words, the middle portion G23 is covered with the body 100 without any clearance therebetween. The middle portion G23 extends (is inclined) from the contact portion G21 to the connecting portion G22 in an oblique direction including the X- and Y'-direction components. The middle portion G23 is disposed on the X'-direction side relative to and in spaced relation to the middle portion S2*a*3 of the terminal S2*a*.

The terminals S4*a* and S4*b* are similar in configuration to the terminals S3*a* and S3*b* but different in the configuration of the middle portion. More particularly, in each of the terminals S4*a* and S4*b*, the inclination angle of the middle portion relative to the contact portion is larger than each inclination angle of the middle portions S3*a*3 and S3*b*3 of the terminals S3*a* and S3*b* relative to the contact portions S3*a*1 and S3*b*1, respectively. The terminals S4*a* and S4*b* will not be further described with regard to the overlaps with the terminals S3*a* and S3*b*.

The terminal G5 is similar in configuration to the terminal G3*b* but different in the configuration of the middle portion. More particularly, the middle portion of the terminal G5 has a width slightly larger than that of the middle portion G3*b*3 of the terminal G3*b*, and the inclination angle of the middle portion relative to a contact of the terminal G5 is larger than the inclination angle of the middle portion G3*b*3 relative to the contact portion G3*b*1 of the terminal G3*b*. The terminal G5 will not be further described with regard to the overlaps with the terminal G3*b*.

The terminals S1*a* and S1*b* are similar in configuration to the terminals S2*a* and S2*b* but different in the configuration of the middle portion. More particularly, in each of the terminals S1*a* and S1*b*, the inclination angle of the middle portion relative to the contact portion is smaller than each inclination angle of the middle portions S2*a*3 and S2*b*3 of the terminals S2*a* and S2*b* relative to the contact portions S2*a*1 and S2*b*1, respectively. The terminals S1*a* and S1*b* will not be further described with regard to the overlaps with the terminals S2*a* and S2*b*.

The terminal G1 extends in the Y-Y' direction such as to be located on the X'-direction side relative to the terminal S1*a*. The terminal G1 may be a ground terminal. The terminal G1 may alternatively be a low-speed signal terminal adapted to transmit signals at a lower speed than signals transmitted through the terminals S1*b* and S1*a*. For example, the low-speed signal terminal may be a single-ended signal terminal, a power terminal, or a terminal of other functions, and may be adapted to transmit signals of frequency at most 1/10 or at most 1/100 of the frequency of signals transmitted through the terminals S1*b* and S1*a*. The terminal G1 corresponds to the remaining fourth terminal set forth in the claims.

As best illustrated in FIG. 3, the terminal G1 includes a contact portion G11, a connecting portion G12, and a middle portion G13. The contact portion G11 is similar in configuration to the contact portion G3*b*1 and is disposed on the X'-direction side relative to and in spaced relation to the contact portion S1*a*1 of the terminal S1*a*. The connecting portion G12 is similar in configuration to the connecting portion G3*b*2 and is disposed on the X'-direction side relative to and in spaced relation to the connecting portion S1*a*2 of the terminal S1*a*. The connecting portion G12 is located on the Y'-direction side relative to the contact portion G11. The connecting portion G12 is located at the same height as the contact portion G11.

The middle portion G13 is provided between the contact portion G11 and the front portion of the connecting portion G12, contiguously connected between the contact portion G11 and the connecting portion G12, and is held in the body 100. In other words, the middle portion G13 is covered with the body 100 without any clearance therebetween. The middle portion G13 extends in the Y' direction from the contact portion G11 to the connecting portion G12. The middle portion G13 is located on the X'-direction side relative to and in spaced relation to the middle portion S1a3 of the terminal S1a.

The body 100 as illustrated in FIG. 1 to FIG. 3 is molded of an insulating plastic material. The body 100 includes a first face 101, a second face 102, first portions 110a and 110b, second portions 120a and 120b, third portions 130a and 130b, a first recess 140, and a second recess 150.

As best illustrated in FIG. 3, the first portion 110a is a part of the body 100 (a part of the plastic material) that is sandwiched between the terminal S2a and the terminal S2b such as to extend along the terminal S2a and the terminal S2b.

The second portion 120a is a part of the body 100 (a part of the plastic material) that is sandwiched between the terminal S2b and the terminal G3a such as to extend along the terminal S2b and the terminal G3a. The second portion 120a has a second void 121a. More particularly, the second void 121a is provided in a part of the second portion 120a in the length direction thereof and extends from the terminal S2b to the terminal G3a. An exposed portion (to be described) of the terminal S2b and an exposed portion (to be described) of the terminal G3a partially face each other on opposite sides of the second void 121a.

The third portion 130a is a part of the body 100 (a part of the plastic material) that is sandwiched between the terminal S2a and the terminal G2 such as to extend along the terminal S2a and the terminal G2. The third portion 130a has a third void 131a. More particularly, the third void 131a is provided in a part of the third portion 130 in the length direction thereof and extends from the terminal S2a to the terminal G2. An exposed portion (to be described) of the terminal S2a and An exposed portion (to be described) of the terminal G2 partially face each other on opposite sides of the third void 131a.

The first portion 110b is a part of the body 100 (a part of the plastic material) that is sandwiched between the terminal S3a and the terminal S3b such as to extend along the terminal S3a and the terminal S3b.

The second portion 120b is a part of the body 100 (a part of the plastic material) that is sandwiched between the terminal S3b and the terminal G4 such as to extend along the terminal S3b and the terminal G4. The second portion 120b has a second void 121b. More particularly, the second void 121b is provided in a part of the second portion 120b in the length direction thereof and extends from the terminal S3b to the terminal G4. An exposed portion (to be described) of the terminal S3b and An exposed portion (to be described) of the terminal G4 partially face each other on opposite sides of the second void 121b.

The third portion 130b is a part of the body 100 (a part of the plastic material) that is sandwiched between the terminal S3a and the terminal G3b such as to extend along the terminal S3a and the terminal G3b. The third portion 130b has a third void 131b. More particularly, the third void 131b is provided in a part of the third portion 130b in the length direction thereof and extends from the terminal S3a to the terminal G3b. An exposed portion (to be described) of the terminal S3a and an exposed portion (to be described) of the terminal G3b partially face each other on opposite sides of the third void 131b. The third void 131a, the second void 121a, the third void 131b, and the second void 121b are arrayed along the X-X' direction.

As best illustrated in FIG. 2, the first recess 140 is provided in a portion on the Z-direction side relative to the second void 121a, the third void 131a, the second void 121b, and the third void 131b of the body 100. The first recess 140 communicates with the second void 121a, the third void 131a, the second void 121b, and the third void 131b. The first recess 140 extends in the X-X' direction and opens to the first face 101 of the body 100. The first recess 140 allows exposure to the Z-direction side of the entire area (the exposed portion mentioned above) of a lengthwise part of each terminal S2a, S2b, G3a, G3b, S3a, and S3b, an area on the X-direction side (the exposed portion mentioned above) of a lengthwise part of the terminal G2, and an area on an X'-direction side (the exposed portion mentioned above) of a lengthwise part of the terminal G4. In the terminal G2, the area on the X'-direction side of the above-described part, i.e. the area excluding the exposed portion (hereinafter referred to as an unexposed portion), is held in the body 100. In the terminal G4, the area on the X-direction side of the above-described part, i.e. the area excluding the exposed portion (hereinafter referred to as an unexposed portion), is also held in the body 100.

The second recess 150 is provided in a portion on the Z'-direction side relative to the second void 121a, the third void 131a, the second void 121b, and the third void 131b of the body 100. The second recess 150 communicates with the second void 121a, the third void 131a, the second void 121b, and the third void 131b. The second recess 150 extends in the X-X' direction and opens to the second face 102 of the body 100. The second recess 150 allows exposure to the Z'-direction side of the exposed portions of the terminals S2a, S2b, G3a, G3b, S3a, and S3b, the exposed portion of the terminal G2, and the exposed portion of the terminal G4.

Figure 4:
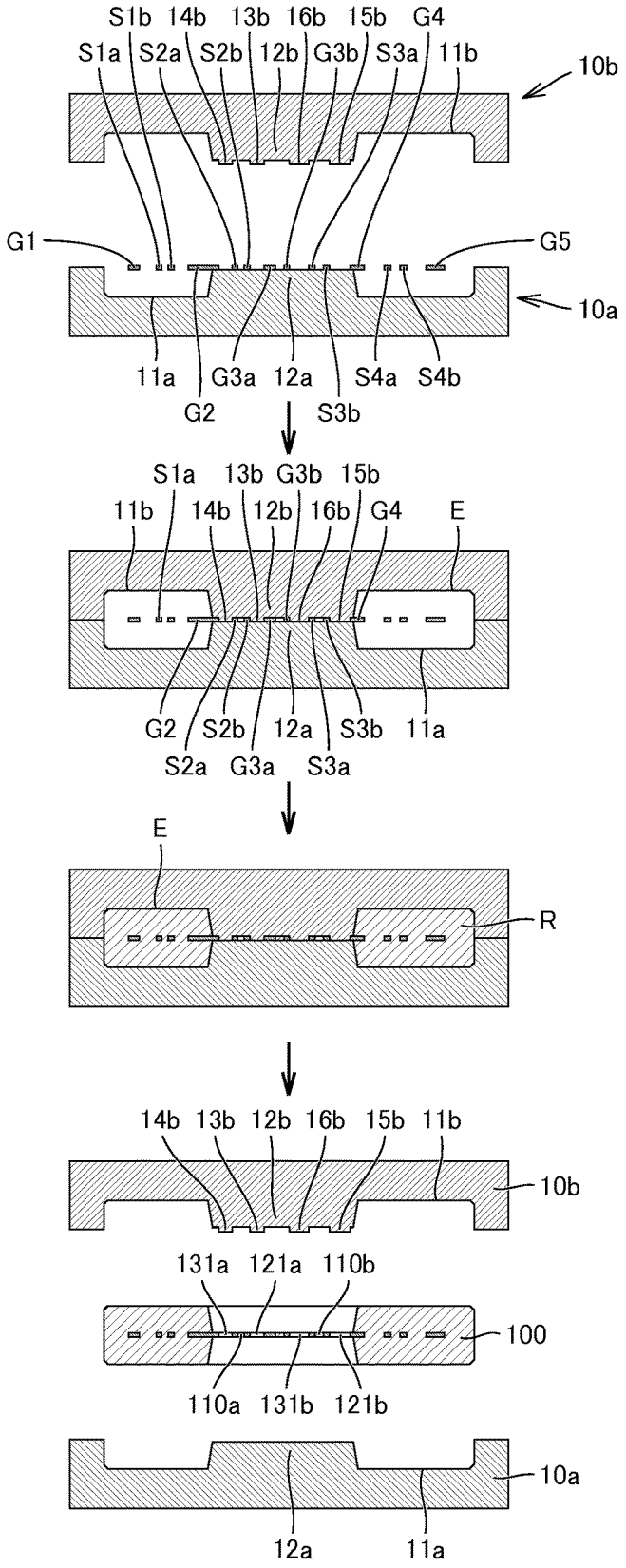
FIG. 4 is a schematic end view corresponding to FIG. 2 and illustrating steps of a method of manufacturing the connector.

The connector C1 may be manufactured using a first mold 10a and a second mold 10b as shown in FIG. 4. The first mold 10a has a recess 11a and a first retainer 12a. The second mold 10b has a recess 11b, a second retainer 12b, a protrusion 13b (second protrusion), a protrusion 14b (third protrusion), a protrusion 15b (second protrusion), and a protrusion 16b (third protrusion).

The recess 11a of the first mold 10a has a shape generally corresponding to the shape of the Z'-direction side half of the body 100. The first retainer 12a of the first mold 10a is provided centrally of the bottom of the recess 11a. The first retainer 12a extends in the X-X' direction and has an external shape corresponding to the shape of the second recess 150 of the body 100.

The recess 11b of the second mold 10b has a shape generally corresponding to the shape of the other half, i.e. the Z-direction side half, of the body 100. The second retainer 12b of the second mold 10b is provided centrally of the ceiling of the recess 11b. The second retainer 12b extends in the X-X' direction and has an external shape corresponding to the shape of the first recess 140 of the body 100. The protrusion 13b is provided on the distal face of the second retainer 12b, more particularly at a position corresponding to the second void 121a of the body 100. The protrusion 13b has an external shape corresponding to the shape of the second void 121a. The protrusion 13b is contactable with the end face on the X-direction side of the exposed portion of the terminal S2b and the end face on the X'-direction side of the exposed portion of the terminal G3a. The protrusion 14b is provided on the distal face of the second retainer 12b, more particularly at a position corresponding to the third void 131a of the body 100. The protrusion 14*b* has an external shape corresponding to the shape of the third void 131*a*. The protrusion 14*b* is contactable with the end face on the X-direction side of the exposed portion of the terminal G2 and the end face on the X'-direction side of the exposed portion of the terminal S2*a*. The protrusion 15*b* is provided on the distal face of the second retainer 12*b*, more particularly at a position corresponding to the second void 121*b* of the body 100. The protrusion 15*b* has an external shape corresponding to the shape of the second void 121*b*. The protrusion 15*b* is contactable with the end face on the X-direction side of the exposed portion of the terminal S3*b* and the end face on the X'-direction side of the exposed portion of the terminal G4. The protrusion 16*b* is provided on the distal face of the second retainer 12*b*, more particularly at a position corresponding to the third void 131*b* of the body 100. The protrusion 16*b* has an external shape corresponding to the shape of the third void 131*b*. The protrusion 16*b* is contactable with the end face on the X-direction side of the exposed portion of the terminal G3*b* and the end face of the X'-direction side of the exposed portion of the terminal S3*a*.

The first mold 10*a* and the second mold 10*b* can be closed together to form a cavity E, which is defined by the recesses 11*a* and 11*b*, the first retainer 12*a*, the second retainer 12*b*, the protrusion 13*b*, the protrusion 14*b*, the protrusion 15*b*, and the protrusion 16*b*.

Described below referring to FIG. 4 is a first method of manufacturing the connector C1 using the first mold 10*a* and the second mold 10*b*. First prepared are the terminals of the terminal group 200. The terminals are disposed on the first mold 10*a* in spaced relation to each other along the X-X' direction, in the order of G1, S1*a*, S1*b*, G2, S2*a*, S2*b*, G3*a*, G3*b*, S3*a*, S3*b*, G4, S4*a*, S4*b*, and G5. More particularly, the terminals S2*a* and S2*b* are disposed in spaced relation to each other along the X-X' direction; the terminal G3*a* is disposed on the X-direction side relative to and in spaced relation to the terminal S2*b*; the terminal G2 is disposed on the X'-direction side relative to and in spaced relation to the terminal S2*a*; the terminals S3*a* and S3*b* are disposed in spaced relation to each other along the X-X' direction; the terminal G4 is disposed on the X-direction side relative to and in spaced relation to the terminal S3*b*; and the terminal G3*b* is disposed on the X'-direction side relative to and in spaced relation to the terminal S3*a*. In this arrangement of the terminals G2, S2*a*, S2*b*, G3*a*, G3*b*, S3*a*, S3*b*, and G4, the exposed portions of the terminals are in contact with the distal face of the first retainer 12*a* of the first mold 10*a*.

Then, the first mold 10*a* and the second mold 10*b* are closed together. This causes the terminals G1, S1*a*, S1*b*, G2, S2*a*, S2*b*, G3*a*, G3*b*, S3*a*, S3*b*, G4, S4*a*, S4*b*, and G5 to be partially housed in the cavity E of the first and second molds 10*a*, 10*b*.

The closing of the first mold 10*a* and the second mold 10*b* includes the following steps. The protrusion 13*b* of the second mold 10*b* is inserted (disposed) between the exposed portion of the terminal S2*b* and the exposed portion of the terminal G3*a* in the cavity E and brought into contact with the end face on the X-direction side of the exposed portion of the terminal S2*b* and the end face on the X'-direction side of the exposed portion of the terminal G3*a*. The protrusion 14*b* of the second mold 10*b* is inserted (disposed) between the exposed portion of the terminal G2 and the exposed portion of the terminal S2*a* in the cavity E and brought into contact with the end face on the X-direction side of the exposed portion of the terminal G2 and the end face on the X'-direction side of the exposed portion of the terminal S2*a*. The protrusion 15*b* of the second mold 10*b* is inserted (disposed) between the exposed portion of the terminal S3*b* and the exposed portion of the terminal G4 in the cavity E and brought into contact with the end face on the X-direction side of the exposed portion of the terminal S3*b* and the end face on the X'-direction side of the exposed portion of the terminal G4. The protrusion 16*b* of the second mold 10*b* is inserted (disposed) between the exposed portion of the terminal G3*b* and the exposed portion of the terminal S3*a* in the cavity E and brought into contact with the end face on the X-direction side of the exposed portion of the terminal G3*b* and the end face on the X'-direction side of the exposed portion of the terminal S3*a*. The second retainer 12*b* of the second mold 10*b* is brought into contact with the exposed portions of the terminals G2, S2*a*, S2*b*, G3*a*, G3*b*, S3*a*, S3*b*, and G4. Accordingly, the first retainer 12*a* of the first mold 10*a* and the second retainer 12*b* of the second mold 10*b* hold therebetween the exposed portions of the terminals G2, S2*a*, S2*b*, G3*a*, G3*b*, S3*a*, S3*b*, and G4.

The closing of the first mold 10*a* and the second mold 10*b* also includes placing the following portions in the air in the cavity E: the front portion of the connecting portion G12 and the middle portion G13 of the terminal G1, the front portion of the connecting portion S1*a*2 and the middle portion S1*a*3 of the terminal S1*a*, the front portion of the connecting portion S1*b*2 and the middle portion S1*b*3 of the terminal S1*b*, the front portion of the connecting portion G22 and the portion other than the exposed portion (including the unexposed portion) of the middle portion G23 of the terminal G2, the front portion of the connecting portion S2*a*2 and the portion other than the exposed portion of the middle portion S2*a*3 of the terminal S2*a*, the front portion of the connecting portion S2*b*2 and the portion other than the exposed portion of the middle portion S2*b*3 of the terminal S2*b*, the front portion of the connecting portion G3*a*2 and the portion other than the exposed portion of the middle portion G3*a*3 of the terminal G3*a*, the front portion of the connecting portion G3*b*2 and the portion other than the exposed portion of the middle portion G3*b*3 of the terminal G3*b*, the front portion of the connecting portion S3*a*2 and the portion other than the exposed portion of the middle portion S3*a*3 of the terminal S3*a*, the front portion of the connecting portion S3*b*2 and the portion other than the exposed portion of the middle portion S3*b*3 of the terminal S3*b*, the front portion of the connecting portion G42 and the portion other than the exposed portion (including the unexposed portion) of the middle portion G43 of the terminal G4, the front portion of the connecting portion S4*a*2 and the middle portion S4*a*3 of the terminal S4*a*, the front portion of the connecting portion S4*b*2 and the middle portion S4*b*3 of the terminal S4*b*, and a front portion of a connecting portion G52 and a middle portion G53 of the terminal G5. Theses portions disposed in the cavity E may each be referred to hereinafter as an insert portion.

Subsequently, an insulating plastic material R is injected into the cavity E of the first and second molds 10*a*, 10*b*. This causes the insert portions of the terminals G1, S1*a*, S1*b*, G2, S2*a*, S2*b*, G3*a*, G3*b*, S3*a*, S3*b*, G4, S4*a*, S4*b*, and G5 to be inserted into the plastic material R. More particularly, the plastic material R flows in between portions other than the exposed portions of the insert portions of the terminals G2 and S2*a*, in between the insert portions of the terminals S2*a* and S2*b*, in between portions other than the exposed portions of the insert portions of the terminals S2*b* and G3*a*, in between portions other than the exposed portions of the insert portions of the terminals G3*b* and S3*a*, in between the insert portions of the terminals S3*a* and S3*b*, and in between portions other than the exposed portions of the insert portions of the terminals S3*b* and G4. The contact portions of the terminals G1, S1*a*, S1*b*, G2, S2*a*, S2*b*, G3*a*, G3*b*, S3*a*, S3*b*, G4, S4*a*, S4*b*, and G5 remain outside of the plastic material R, protruding in the Y direction. The rear portions of the connecting portions of the terminals G1, S1*a*, S1*b*, G2, S2*a*, S2*b*, G3*a*, G3*b*, S3*a*, S3*b*, G4, S4*a*, S4*b*, and G5 also remain outside of the plastic material R, protruding in the Y' direction.

Subsequently, the plastic material R in the cavity E hardens to form the body 100. The body 100 thus holds the insert portions of the terminals G1, S1*a*, S1*b*, G2, S2*a*, S2*b*, G3*a*, G3*b*, S3*a*, S3*b*, G4, S4*a*, S4*b*, and G5 in spaced relation to each other along the X-X' direction (the terminals are insert-molded in the body 100). The plastic material R between the portions other than the exposed portions of the insert portions of the terminals G2 and S2*a* becomes the third portion 130*a*. The plastic material R between the insert portions of the terminals S2*a* and S2*b* becomes the first portion 110*a*. The plastic material R between the portions other than the exposed portions of the insert portions of the terminals S2*b* and G3*a* becomes the second portion 120*a*. The plastic material R between the portions other than the exposed portions of the insert portions of the terminals G3*b* and S3*a* becomes the third portion 130*b*. The plastic material R between the insert portions of the terminals S3*a* and S3*b* becomes the first portion 110*b*. The plastic material R between the portions other than the exposed portions of the insert portions of the terminals S3*b* and G4 becomes the second portion 120*b*. The second recess 150 of the body 100 is shaped conforming to the external shape of the first retainer 12*a*, and the first recess 140 of the body 100 is shaped conforming to the external shape of the second retainer 12*b*. The third void 131*a* is shaped, conforming to the external shape of the protrusion 14*b*, between the exposed portion of the terminal G2 and the exposed portion of the terminal S2*a*. The second void 121*a* is shaped, conforming to the external shape of the protrusion 13*b*, between the exposed portion of the terminal S2*b* and the exposed portion of the terminal G3*a*. The third void 131*b* is shaped, conforming to the external shape of the protrusion 16*b*, between the exposed portion of the terminal G3*b* and the exposed portion of the terminal S3*a*. The second void 121*b* is shaped, conforming to the external shape of the protrusion 15*b*, between the exposed portion of the terminal S3*b* and the exposed portion of the terminal G4.

Subsequently, the first mold 10*a* and the second mold 10*b* are released. Then, the first retainer 12*a* is removed from the second recess 150 of the body 100. The second retainer 12*b* is removed from the first recess 140 of the body 100. The protrusion 13*b* is removed from the second void 121*a*. The protrusion 14*b* is removed from the third void 131*a*, and the protrusion 15*b* is removed from the second void 121*b*. The protrusion 16*b* is removed from the third void 131*b*. Accordingly, the exposed portions of the terminals G2, S2*a*, S2*b*, G3*a*, G3*b*, S3*a*, S3*b*, and G4 are exposed through the first and the second recesses 140, 150. The terminals of the terminal group 200 are thus insert-molded in the body 100.

A case is also prepared. The body 100 and the terminals of the terminal group 200 are housed in the case. The connector C1 is thus manufactured by the first manufacturing method.

Described below is a second method of manufacturing the connector C1 using first and second molds not shown. The first and second molds to be used are similar in configuration as the first mold 10*a* and the second mold 10*b* but different in the configuration of the protrusions. More particularly, the protrusion 13*b*, the protrusion 14*b*, the protrusion 15*b*, and the protrusion 16*b* are provided not on the distal face of the second retainer 12*b* of the second mold but on the distal face of the first retainer 12*a* of the first mold. For convenience of explanation, constituents of the first and second molds are referred to with the same reference numbers assigned to the constituents of the first and second molds 10*a* and 10*b* used for the first manufacturing method.

First, the terminals of the terminal group 200 are prepared and disposed on the first mold in spaced relation to each other along the X-X' direction, in the order of G1, S1*a*, S1*b*, G2, S2*a*, S2*b*, G3*a*, G3*b*, S3*a*, S3*b*, G4, S4*a*, S4*b*, and G5. The exposed portions of the terminals G2, S2*a*, S2*b*, G3*a*, G3*b*, S3*a*, S3*b*, and G4 are brought into contact with the distal face of the first retainer 12*a* of the first mold.

The disposing of the terminals includes the following steps. The exposed portion of the terminal S2*a* is brought into contact with the protrusion 14*b* from the X-direction side, the exposed portion of the terminal S2*b* is brought into contact with the protrusion 13*b* from the X'-direction side, and the terminals S2*a* and S2*b* are disposed on the first mold in spaced relation to each other along the X-X' direction; the exposed portion of the terminal G3*a* is brought into contact with the protrusion 13*b* from the X-direction side, and the terminal G3*a* is disposed on the X-direction side relative to and in spaced relation to the terminal S2*b*; and the exposed portion of the terminal G2 is brought into contact with the protrusion 14*b* from the X'-direction side, and the terminal G2 is disposed on the X'-direction side relative to and in spaced relation to the terminal S2*a*. Upon disposing the terminals S2*a*, S2*b*, G3*a*, G2 on the first mold as described above, the protrusion 13*b* is located between the exposed portion of the terminal S2*b* and the exposed portion of the terminal G3*a*, in contact with the end face on the X-direction side of the exposed portion of the terminal S2*b* and the end face on the X'-direction side of the exposed portion of the terminal G3*a*; the protrusion 14*b* is located between the exposed portion of the terminal G2 and the exposed portion of the terminal S2*a*, in contact with the end face on the X-direction side of the exposed portion of the terminal G2 and the end face on the X'-direction side of the exposed portion of the terminal S2*a*. The disposing of the terminals further includes the following steps. The exposed portion of the terminal S3*a* is brought into contact with the protrusion 16*b* from the X-direction side, the exposed portion of the terminal S3*b* is brought into contact with the protrusion 15*b* from the X'-direction side, so that the terminals S3*a* and S3*b* are disposed on the first mold in spaced relation to each other along the X-X' direction; the exposed portion of the terminal G4 is brought into contact with the protrusion 16*b* from the X-direction side, and the terminal G4 is disposed on the X-direction side relative to and in spaced relation to the terminal S3*b*; and the exposed portion of the terminal G3*b* is brought into contact with the protrusion 15*b* from the X'-direction side, and the terminal G3*b* is disposed on the X'-direction side relative to and in spaced relation to the terminal S3*a*. Upon disposing the terminals S3*a*, S3*b*, G4, and G3*b* on the first mold as described above, the protrusion 15*b* is located between the exposed portion of the terminal S3*b* and the exposed portion of the terminal G4, in contact with the end face on the X-direction side of the exposed portion of the terminal S3*b* and the end face on the X'-direction side of the exposed portion of the terminal G4; and the protrusion 16*b* is located between the exposed portion of the terminal G3*b* and the exposed portion of the terminal S3*a*, in contact with the end face on the X-direction side of the exposed portion of the terminal G3*b* and the end face on the X'-direction side of the exposed portion of the terminal S3*a*.

Subsequently, the first and second molds are closed together. This causes the terminals G1, S1*a*, S1*b*, G2, S2*a*, S2*b*, G3*a*, G3*b*, S3*a*, S3*b*, G4, S4*a*, S4*b*, and G5 to be partially housed in the cavity E of the first and second molds.

The closing of the first and second molds includes the following steps. The second retainer 12*b* of the second mold is brought into contact with the exposed portions of the terminals G2, S2*a*, S2*b*, G3*a*, G3*b*, S3*a*, S3*b*, and G4. Accordingly, the first retainer 12*a* of the first mold and the second retainer 12*b* of the second mold hold therebetween the exposed portions of the terminals G2, S2*a*, S2*b*, G3*a*, G3*b*, S3*a*, S3*b*, and G4. This holding can maintain the following states: 1) a state where the protrusion 13*b* of the first mold is located between the exposed portion of the terminal S2*b* and the exposed portion of the terminal G3*a* in the cavity E, in contact with the end face on the X-direction side of the exposed portion of the terminal S2*b* and the end face on the X'-direction side of the exposed portion of the terminal G3*a;* 2) a state where the protrusion 14*b* of the first mold is located between the exposed portion of the terminal G2 and the exposed portion of the terminal S2*a* in the cavity E, in contact with the end face on the X-direction side of the exposed portion of the terminal G2 and the end face on the X'-direction side of the exposed portion of the terminal S2*a;* 3) a state where the protrusion 15*b* of the first mold is located between the exposed portion of the terminal S3*b* and the exposed portion of the terminal G4 in the cavity E, in contact with the end face on the X-direction side of the exposed portion of the terminal S3*b* and the end face on the X'-direction side of the exposed portion of the terminal G4; and 4) a state where the protrusion 16*b* of the first mold is located between the exposed portion of the terminal G3*b* and the exposed portion of the terminal S3*a* in the cavity E, in contact with the end face on the X-direction side of the exposed portion of the terminal G3*b* and the end face on the X'-direction side of the exposed portion of the terminal S3*a*.

Subsequently, insulating plastic material R is injected into the cavity of the first and second molds so as to inserted-mold the terminals of the terminal group 200 in the body 100 in a similar manner to the first method. The connector C1 is thus manufactured by the second manufacturing method.

The first and second molds 10*a* and 10*b* may also be modified such that the protrusion 13*b* and the protrusion 15*b* are provided not on the distal face of the second retainer 12*b* of the second mold 10*b* but on the distal face of the first retainer 12*a* of the first mold 10*a*, i.e. the second retainer 12*b* of the second mold 10*b* is formed only with the protrusion 14*b* and the protrusion 16*b*. Those skilled in the art should be able to understand that the converse modification can also be made.

The connector C1 can be connected a mating connector in the following manner. When a mating connector is inserted in the connection hole of the connector C1, contact portions of the mating connector are brought into contact with the contact portions of the terminals of the connector C1. On the other hand, the connecting portions of the terminals of the connector C1 can be brought into contact with terminals of a circuit board or another connector. The connector C1 can be thus connected to the circuit board or another connector.

The connector C1 and the methods of manufacturing the connector C1 described above have at least the following technical features. First, even when the terminals of the terminal group 200 are arrayed at small pitches along the X-X' direction, it is easy to match impedances between the terminals S2*a* and S2*b* and between the terminals S3*a* and S3*b* for the following reasons. The first portion 110*a* of plastic material is interposed between the terminals S2*a* and S2*b*. On the other hand, the second portion 120*a* between the terminal S2*b* and the terminal G3*a* is provided with the second void 121*a* extending from the terminal S2*b* to the terminal G3*a*, and the third portion 130*a* between the terminal S2*a* and the terminal G2 is provided with the third void 131*a* extending from the terminal S2*a* to the terminal G2. It should be noted that the second void 121*a* and the third void 131*a* are lower in dielectric constant than the first portion 110*a*, the second portion 120*a*, and the third portion 130*a*. Accordingly, an electric field is unlikely to be generated between the exposed portions of the terminals located on opposite sides of each of the second void 121*a* and the third void 131*a*. This weakens the electrical coupling between the terminal S2*b* and the terminal G3*a* and between the terminal S2*a* and the terminal G2 and strengthens the differential coupling between the terminals S2*a* and S2*b*. As a result, the insert portions (i.e. portions held in the body 100) of the terminals S2*a* and S2*b* can be partially improved in impedance, further facilitating impedance matching between the terminals S2*a* and S2*b* Similarly, the insert portions (portions held in the body 100) of the terminals S3*a* and S3*b* can also be partially improved in impedance, making it easy to match impedances between the terminals S3*a* and S3*b*.

Second, it is easy to provide the body 100 with the second void 121*a*, the third void 131*a*, the second void 121*b*, and the third void 131*b*. These voids can be shaped readily in the body 100 simply by injecting plastic material R into the cavity E, inside which the protrusion 13*b* is disposed between the exposed portion of the terminal S2*b* and the exposed portion of the terminal G3*a*, the protrusion 14*b* is disposed between the exposed portion of the terminal G2 and the exposed portion of the terminal S2*a*, the protrusion 15*b* is disposed between the exposed portion of the terminal S3*b* and the exposed portion of the terminal G4, and the protrusion 16*b* is disposed between the exposed portion of the terminal G3*b* and the exposed portion of the terminal S3*a*.

Third, it is possible to reduce the possibility at the time of injection molding of the body 100 that the flow of the plastic material may cause displacement or deformation of the terminals G2, S2*a*, S2*b*, G3*a*, G3*b*, S3*a*, S3*b*, and G4. This is because the exposed portions of the terminals G2, S2*a*, S2*b*, G3*a*, G3*b*, S3*a*, S3*b*, and G4 are held between the first retainer 12*a* of the first mold 10*a* and the second retainer 12*b* of the second mold 10*b*. Also, the protrusion 13*b* is in contact with the exposed portion of the terminal S2*b* and the exposed portion of the terminal G3*a*, the protrusion 14*b* is in contact with the exposed portion of the terminal G2 and the exposed portion of the terminal S2*a*, the protrusion 15*b* is in contact with the exposed portion of the terminal S3*b* and the exposed portion of the terminal G4, and the protrusion 16*b* is in contact with the exposed portion of the terminal G3*b* and the exposed portion of the terminal S3*a*.

Second Embodiment

A connector C2 in the second embodiment of the invention will be described below with reference to FIG. 5 to FIG. 8. The connector C2 is similar in configuration to the connector C1 but different in the configuration of a body 100' from that of the body 100. The differences will be described below in detail, and overlapping descriptions will be omitted. A prime (') will be added to each of reference numerals of the body of the connector C2 and its sub-elements to distinguish them from the body and its sub-elements of the connector C1. As in the first embodiment, the X-X' direction is indicated in FIG. 5 to FIG. 7, the Y-Y' direction is indicated in FIG. 5 and FIG. 7, and the Z-Z' direction is indicated in FIG. 6.

Figure 5:
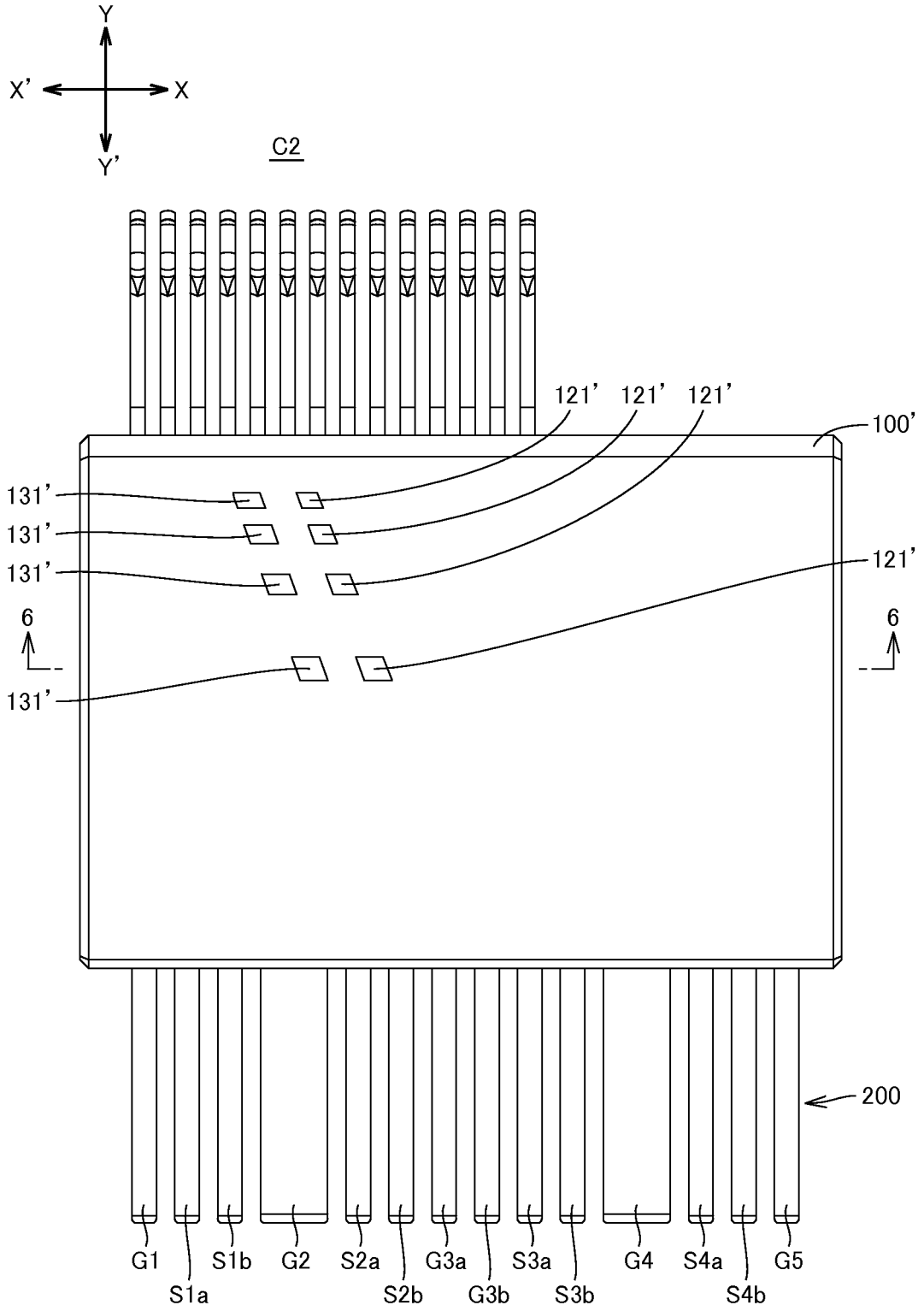
FIG. 5 is a plan view of a body and a terminal group of a connector in the second embodiment of the invention.
Figure 6:
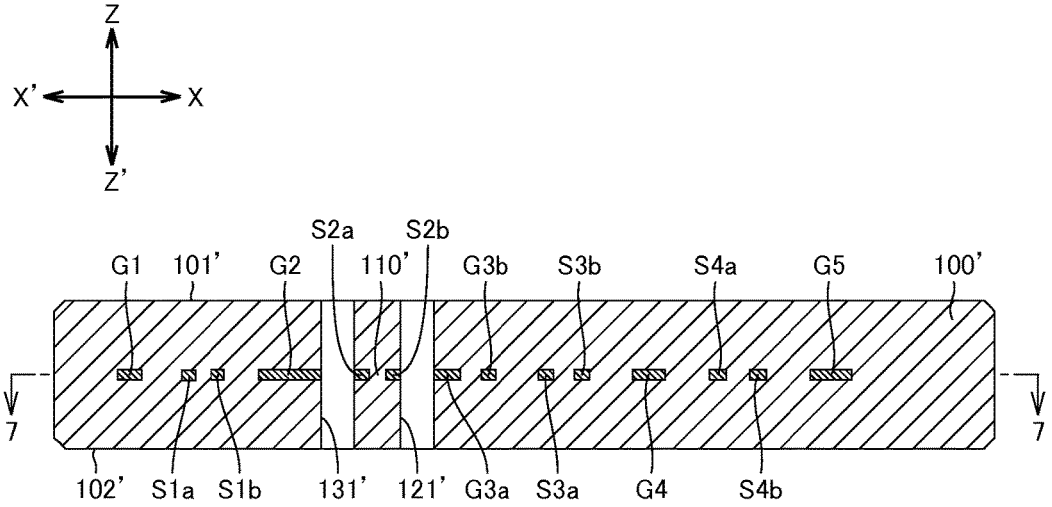
FIG. 6 is a sectional view of the body and the terminal group, taken along 6-6 in FIG. 5.
Figure 7:
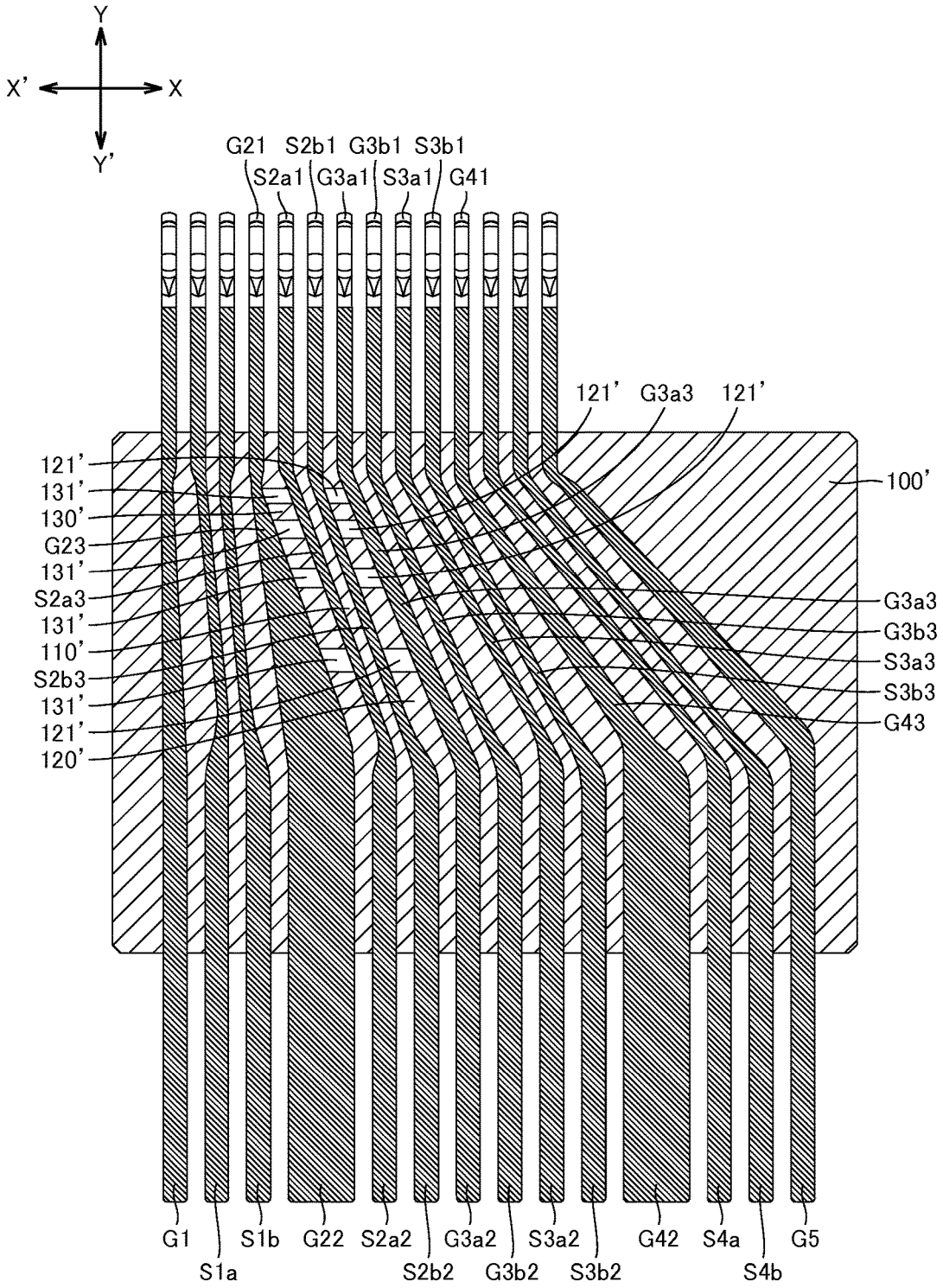
FIG. 7 is a sectional view of the body and the terminal group, taken along 7-7 in FIG. 6.

As illustrated in FIG. 5 to FIG. 7, the body 100' is molded of an insulating plastic material. The body 100' includes a first face 101', a second face 102', a first portion 110', a second portion 120', and a third portion 130'.

As best illustrated in FIG. 7, the first portion 110' is a part of the body 100' (a part of the plastic material) that is sandwiched between a terminal S2*a* and a terminal S2*b* such as to extend along the terminal S2*a* and the terminal S2*b*.

As best illustrated in FIG. 7, the second portion 120' is a part of the body 100' (a part of the plastic material) that is sandwiched between the terminal S2*b* and a terminal G3*a* such as to extend along the terminal S2*b* and the terminal G3*a*. The second portion 120' has a plurality of second voids 121'. More particularly, the second voids 121' are provided in a part of the second portion 120' in the length direction thereof and spaced apart in the above length direction. Each second void 121' extends from the terminal S2*b* to the terminal G3*a*. As illustrated in FIG. 6, each second void 121' extends also in the Z-Z' direction and opens to the first face 101' and the second face 102' of the body 100'. The terminal S2*b* and the terminal G3*a* are opposed to each other at a plurality of locations (hereinafter referred to as opposable faces) on opposite sides of the second voids 121'. The opposable faces of the terminal S2*b* are lengthwise parts of the end face on the X-direction side of the terminal S2*b*. The opposable faces of the terminal G3*a* are lengthwise parts of the end face on the X'-direction side of the terminal G3*a*.

As best illustrated in FIG. 7, the third portion 130' is a part of the body 100' (a part of the plastic material) that is sandwiched between the terminal S2*a* and a terminal G2 such as to extend along the terminal S2*a* and the terminal G2. The third portion 130' has a plurality of third voids 131'. More particularly, the third voids 131' are provided in a part of the third portion 130' in the length direction thereof and spaced apart in the above length direction. Each third void 131' extends from the terminal S2*a* to the terminal G2. As illustrated in FIG. 6, each of third void 131' extends also in the Z-Z' direction and opens to the first face 101' and the second face 102' of the body 100'. The terminal S2*a* and the terminal G2 are opposed to each other at a plurality of locations (hereinafter referred to as opposable faces) on opposite sides of the third voids 131'. The opposable faces of the terminal S2*a* are lengthwise parts of the end face on the X'-direction side of the terminal S2*a*. The opposable faces of the terminal G2 are lengthwise parts of the end face on the X-direction side of the terminal G2.

As described above, the body 100' does not have the first recess 140 or the second recess 150 unlike the connector C1. Accordingly, the terminals G2, S2*a*, S2*b*, G3*a*, G3*b*, S3*a*, S3*b*, and G4 each have no exposed portions.

Figure 8:
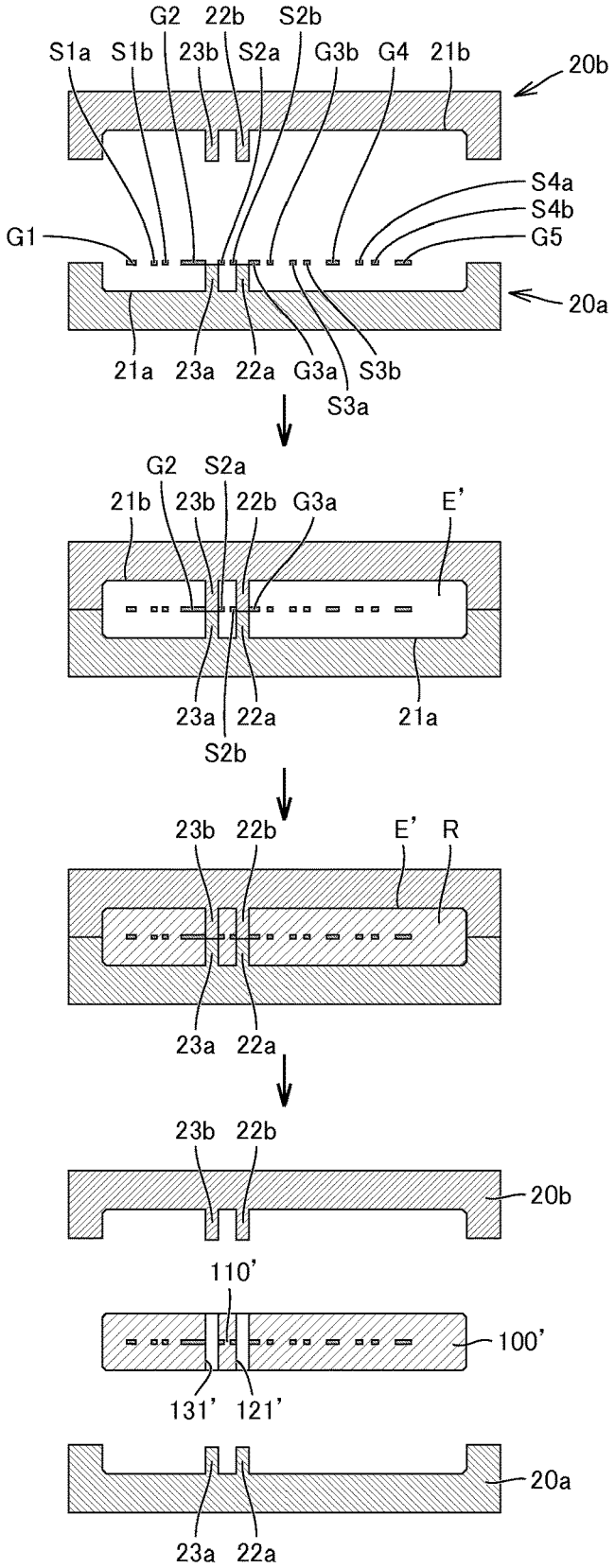
FIG. 8 is a schematic end view corresponding to FIG. 6 and illustrating steps of a method of manufacturing the connector.

The connector C2 may be manufactured using a first mold 20*a* and a second mold 20*b* as shown in FIG. 8. The first mold 20*a* has a recess 21*a*, a plurality of protrusions 22*a* (second protrusions), and a plurality of protrusions 23*a* (third protrusions). The second mold 20*b* has a recess 21*b*, a plurality of protrusions 22*b* (second protrusions), and a plurality of protrusions 23*b* (third protrusions). For reasons of illustration, FIG. 8 shows one protrusion 22*a*, one protrusion 23*a*, one protrusion 22*b*, and one protrusion 23*b*.

The recess 21*a* of the first mold 20*a* has a shape generally corresponding to the shape of the Z'-direction side half of the body 100. The protrusions 22*a* of the first mold 20*a* are provided respectively at locations corresponding to the second voids 121' of the body 100' on the bottom of the recess 21*a*. Each protrusion 22*a* has an external shape generally corresponding to the shape of the Z'-direction side half of the corresponding second void 121'. The protrusions 23*a* of the first mold 20*a* are provided respectively at locations corresponding to the third voids 131' of the body 100' on the bottom of the recess 21*a*. Each protrusion 23*a* has an external shape generally corresponding to the shape of the Z'-direction side half of the corresponding third void 131'.

The recess 21*b* of the second mold 20*b* has a shape generally corresponding to the shape of the other half, i.e. the Z-direction side half, of the body 100. The protrusions 22*b* of the second mold 20*b* are provided respectively at locations corresponding to the second voids 121' of the body 100' on the ceiling of the recess 21*b*. Each protrusion 22*b* has an external shape generally corresponding to the shape of the Z-direction side half of the corresponding second void 121'. Each protrusion 22*b* is larger in the Z-Z' direction than each protrusion 22*a* by the thickness of the terminal S2*b* and also by the thickness of the terminal G3*a*. The protrusions 22*b* are respectively contactable with the opposable faces of the terminal S2*b* and the opposable faces of the terminal G3*a*. The protrusions 23*b* of the second mold 20*b* are provided respectively at locations corresponding to the third voids 131' of the body 100' on the ceiling of the recess 21*b*. Each protrusion 23*b* has an external shape generally corresponding to the shape of the Z-direction side half of the corresponding third void 131'. Each protrusion 23*b* is larger in the Z-Z' direction than each protrusion 23*a* by thickness of the terminal G2 and also by the thickness of the terminal S2*a*. The protrusions 23*b* are respectively contactable with the opposable faces of the terminal G2 and the opposable faces of the terminal S2*a*.

The first mold 20*a* and the second mold 20*b* can be closed together to form a cavity E', which is defined by the recesses 21*a* and 21*b*, the protrusions 22*a* and 22*b*, and the protrusions 23*a* and 23*b*.

Described below referring to FIG. 8 is a first method of manufacturing the connector C2 using the first mold 20*a* and the second mold 20*b*. First prepared are the terminals of the terminal group 200. As in the first embodiment, the terminals are disposed on the first mold 20*a* in spaced relation to each other along the X-X' direction.

Subsequently, the first mold 20*a* and the second mold 20*b* are closed together. This causes the terminals G1, S1*a*, S1*b*, G2, S2*a*, S2*b*, G3*a*, G3*b*, S3*a*, S3*b*, G4, S4*a*, S4*b*, and G5 to be partially housed in the cavity E' of the first and the second molds 20*a*, 20*b*.

The closing of the first mold 20*a* and the second mold 20*b* includes the following steps. The protrusions 22*b* of the second mold 20*b* are inserted (disposed) between the associated opposable faces of the terminal S2*b* and the associated opposable faces of the terminal G3*a* in the cavity E' and brought into contact with the associated opposable faces of the terminal S2*b* and the associated opposable faces of the terminal G3*a*. Distal faces of the protrusions 22*b* are brought into contact with the associated distal faces of the protrusions 22*a*. The protrusions 23*b* of the second mold 20*b* are inserted (disposed) between the associated opposable faces of the terminal G2 and the associated opposable faces of the terminal S2*a* in the cavity E' and brought into contact with the associated opposable faces of the terminal G2 and the associated opposable faces of the terminal S2*a*. Distal faces of the protrusions 23*b* are brought into contact with the associated distal faces of the protrusions 23*a*.

The closing of the first mold 20*a* and the second mold 20*b* also includes placing the following portions in the air in the cavity E': front portions of connecting portions and middle portions of the terminals G1, S1*a*, S1*b*, G2, S2*a*, S2*b*, G3*a*, G3*b*, S3*a*, S3*b*, G4, S4*a*, S4*b*, and G5. Theses portions disposed in the cavity E' may each be referred to hereinafter as an insert portion.

Subsequently, an insulating plastic material R is injected into the cavity E' between the first mold 20*a* and the second mold 20*b*. This causes the insert portions of the terminals G1, S1*a*, S1*b*, G2, S2*a*, S2*b*, G3*a*, G3*b*, S3*a*, S3*b*, G4, S4*a*, S4*b*, and G5 to be inserted into the plastic material R. More particularly, the plastic material R flows in between the insert portions, excluding between the opposable faces, of the terminals G2 and S2*a*; in between the insert portions of the terminals S2*a* and S2*b*; and in between the insert portions, excluding between the opposable faces, of the terminals S2*b* and G3*a*. The contact portions of the terminals G1, S1*a*, S1*b*, G2, S2*a*, S2*b*, G3*a*, G3*b*, S3*a*, S3*b*, G4, S4*a*, S4*b*, and G5 remain outside of the plastic material R protruding in the Y direction. The rear portions of the connecting portions of the terminals G1, S1*a*, S1*b*, G2, S2*a*, S2*b*, G3*a*, G3*b*, S3*a*, S3*b*, G4, S4*a*, S4*b*, and G5 also remain outside of the plastic material R, protruding in the Y' direction.

Subsequently, the plastic material R in the cavity E' hardens to form the body 100'. The body 100' thus holds the insert portions of the terminals G1, S1*a*, S1*b*, G2, S2*a*, S2*b*, G3*a*, G3*b*, S3*a*, S3*b*, G4, S4*a*, S4*b*, and G5 in spaced relation to each other along the X-X' direction (the terminals are insert-molded in the body 100'). The plastic material R between the insert portions, excluding between the opposable faces, of the terminals G2 and S2*a* becomes the third portion 130'. The plastic material R between the insert portions of the terminals S2*a* and S2*b* becomes the first portion 110'. The plastic material R between the insert portions, excluding between the opposable faces, of the terminals S2*b* and G3*a* becomes the second portion 120'. The third voids 131' are shaped, conforming to the external shapes of the protrusions 23*a* and 23*b*, between the terminal G2 and the terminal S2*a*. The second voids 121' are shaped, conforming to the external shapes of the protrusions 22*a* and 22*b*, between the terminal S2*b* and the terminal G3*a* of the body 100'.

Subsequently, the first mold 20*a* and the second mold 20*b* are released. Then, the protrusions 22*a* and 22*b* are removed from the second voids 121'. The protrusions 23*a* and 23*b* are removed from the third voids 131'. The opposable faces of the terminal S2*b* are opposed to the associated opposable faces of the terminal G3*a*. The opposable faces of the terminal G2 are opposed to the associated opposable faces of the terminal S2*a*. The terminals of the terminal group 200 are thus insert-molded in the body 100'.

A case is also prepared. The body 100' and the terminals of the terminal group 200 are housed in the case. The connector C2 is thus manufactured by the first manufacturing method.

Described below is a second method of manufacturing the connector C2 using first and second molds not shown. The first and second molds to be used are similar in configuration as the first mold 20*a* and the second mold 20*b* but different in the configuration of the protrusions. More particularly, each protrusion 22*a* is larger in the Z-Z' direction than each protrusion 22*b* by the thickness of the terminal S2*b* and also by the thickness of the terminal G3*a*. It is the protrusions 22*a* that are contactable with the opposable faces of the terminal S2*b* and the opposable faces of the terminal G3*a*. Each protrusion 23*a* is larger in the Z-Z' direction than each protrusion 23*b* by the thickness of the terminal G2 and also by the thickness of the terminal S2*a*. It is the protrusions 23*a* that are contactable with the opposable faces of the terminal G2 and the opposable faces of the terminal S2*a*. For convenience of explanation, constituents of the first and second molds are referred to with the same reference numbers assigned to the constituents of the first and second molds 20*a* and 20*b* used for the first manufacturing method.

First, the terminals of the terminal group 200 are prepared and disposed on the first mold in spaced relation to each other along the X-X' direction, in the order of G1, S1*a*, S1*b*, G2, S2*a*, S2*b*, G3*a*, G3*b*, S3*a*, S3*b*, G4, S4*a*, S4*b*, and G5. The disposing of the terminals includes the following steps. The opposable faces of the terminal S2*a* are brought into contact with the associated protrusions 23*a* from the X-direction side, the opposable faces of the terminal S2*b* are brought into contact with the associated protrusions 22*a* from the X'-direction side, and the terminals S2*a* and S2*b* are disposed on the first mold in spaced relation to each other along the X-X' direction. The opposable faces of the terminal G3*a* are brought into contact with the associated protrusions 22*a* from the X-direction side, and the terminal G3*a* is disposed on the X-direction side relative to and in spaced relation to the terminal S2*b*. The opposable faces of the terminal G2 are brought into contact with the associated protrusions 23*a* from the X'-direction side, and the terminal G2 is disposed on the X'-direction side relative to and in spaced relation to the terminal S2*a*. Upon disposing the terminals S2*a*, S2*b*, G3*a*, G2 on the first mold as described above, the protrusions 22*a* are located respectively between the opposable faces of the terminal S2*b* and the opposable faces of the terminal G3*a* and brought into contact with the associated opposable faces of the terminal S2*b* and the associated opposable faces of the terminal G3*a*; and the protrusions 23*a* are located respectively between the opposable faces of the terminal G2 and the opposable faces of the terminal S2*a* and brought into contact with the associated opposable faces of the terminal G2 and the associated opposable faces of the terminal S2*a*.

Subsequently, the first and second molds are closed together. This causes the terminals G1, S1*a*, S1*b*, G2, S2*a*, S2*b*, G3*a*, G3*b*, S3*a*, S3*b*, G4, S4*a*, S4*b*, and G5 to be partially housed in the cavity E' of the first and second molds. Also, the distal faces of the protrusions 22*b* are brought into contact with the distal faces of the protrusions 22*a*. The distal faces of the protrusions 23*b* are brought into contact with the distal faces of the protrusions 23*a*.

The following states can be maintained by closing the first and second molds: 1) a state where the protrusions 22*a* of the first mold are located respectively between and in contact with the opposable faces of the terminal S2*b* and the opposable faces of the terminal G3*a* in the cavity E'; and 2) a state where the protrusions 23*a* of the first mold are located respectively between and in contact with the opposable faces of the terminal G2 and the opposable faces of the terminal S2*a* in the cavity E'.

Subsequently, insulating plastic material R is injected into the cavity E' between the first and second molds in a similar manner to the first method so as to inserted-mold the terminals of the terminal group 200 in the body 100'. The connector C2 is thus manufactured by the second manufacturing method.

The connector C2 and the methods of manufacturing the connector C2 as described above have the same first technical feature as that of the connector C1.

Second, it is easy to provide the body 100' with the second voids 121' and the third voids 131'. These voids can be shaped readily in the body 100' simply by injecting plastic material R into the cavity E', inside which the protrusions 22*a* or 22*b* are disposed between the opposable faces of the terminal S2*b* and the opposable faces of the terminal G3*a*, and the protrusions 23*a* or 23*b* are disposed between the opposable faces of the terminal G2 and the opposable faces of the terminal S2*a*.

Third, it is possible to reduce the possibility at the time of injection molding of the body 100' that the flow of the plastic material may cause displacement or deformation of the terminals G2 and S2*b* or the terminals S2*a* and G3*a* for the following reasons. The protrusions 22*a* or 22*b* are in contact with the associated opposable faces of the terminal S2*b* from the X-direction side, and the protrusions 23*a* or 23*b* are in contact with the associated opposable faces of the terminal G2 from the X-direction side. When injecting plastic material R into the cavity E' from the X'-direction side with the terminals G2 and S2*b* arranged as described above, the flow of the plastic material is unlikely to cause displacement or deformation of the terminals G2 and S2*b*. The protrusions 22*a* or 22*b* are in contact with the associated opposable faces of the terminal G3*a* from the X'-direction side, and the protrusions 23*a* or 23*b* are in contact with the associated opposable faces of the terminal S2*a* from the X'-direction side. When injecting plastic material R into the cavity E' from the X-direction side with the terminals S2*a* and G3*a* arranged as described above, the flow of the plastic material is unlikely to cause displacement or deformation of the terminals S2*a* and G3*a*.

It should be noted that the connectors and the methods of manufacturing the connector of the invention are not limited to ones in the above embodiments but may be modified in any manner within the scope of the claims. Specific modifications will be described below in detail.

The first terminals of the invention may be any differential signal terminals in spaced juxtaposition to each other in a first direction such as to extend in a direction including a component of a second direction crossing the first direction. For example, the first terminals may extend straight in the second direction. Alternatively, the first terminals may extend in a direction including components of the first and second directions. Still alternatively, the first terminals may extend in a direction including components of the second direction and a third direction, the third direction crossing the first direction and the second direction. Further alternatively, the first terminals may include a middle portion bent in the first or third direction.

The second terminal of the invention may be any terminal not serving as a differential signal terminal, the second terminal extending in a direction including a component of the second direction such as to be located on one side of the first direction side relative to and in spaced relation to one of the first terminals in the above embodiments and the above variants. For example, the second terminal may extend straight in the second direction. Alternatively, the second terminal may extend in a direction including components of the first and second directions. Still alternatively, the second terminal may extend in a direction including components of the second and third directions. Further alternatively, the second terminal may include a middle portion bent in the first or third direction.

The third terminal of the invention may be any terminal not serving as a differential signal terminal, the third terminal extending in a direction including a component of the second direction such as to be located on the other side of the first direction side relative to and in spaced relation to the other first terminal in the above embodiments and the above variants. For example, the third terminal may extend straight in the second direction. Alternatively, the third terminal may extend in a direction including components of the first and second directions. Still alternatively, the third terminal may extend in a direction including components of the second and third directions. Further alternatively, the third terminal may include a middle portion bent in the first or third direction. It should be appreciated that the terminals G3*a* and G3*b* can be combined into one terminal, which may serve a double function as the second terminal and the third terminal.

The body of the invention may be any body of an insulating plastic material, the body holding the first, second, and third terminals at least partially and including first, second, and third portions in the above embodiments and variants to be described. The body may have at least one hole or recess to hold the first, second, and third terminals in the above embodiments and the above variants at least partially.

The second portion of the body of the invention may be modified in any manner as long as it is provided between the one first terminal and the second terminal and has at least one second void in the above embodiments and variants to be described. The second portion may be plastic material sandwiched between the terminals S1*b* and G2 in the body, between the terminals S2*b* and G3*a* in the body, between the terminals S3*b* and G4 in the body, and/or between the terminals S4*b* and G5 in the body. The width of the second portion in the above embodiments and the above variants may gradually decrease to either side of the length of the second portion. In this case, the width of the second void in the second portion also gradually decreases to either side of the length of the second portion.

Figure 9:
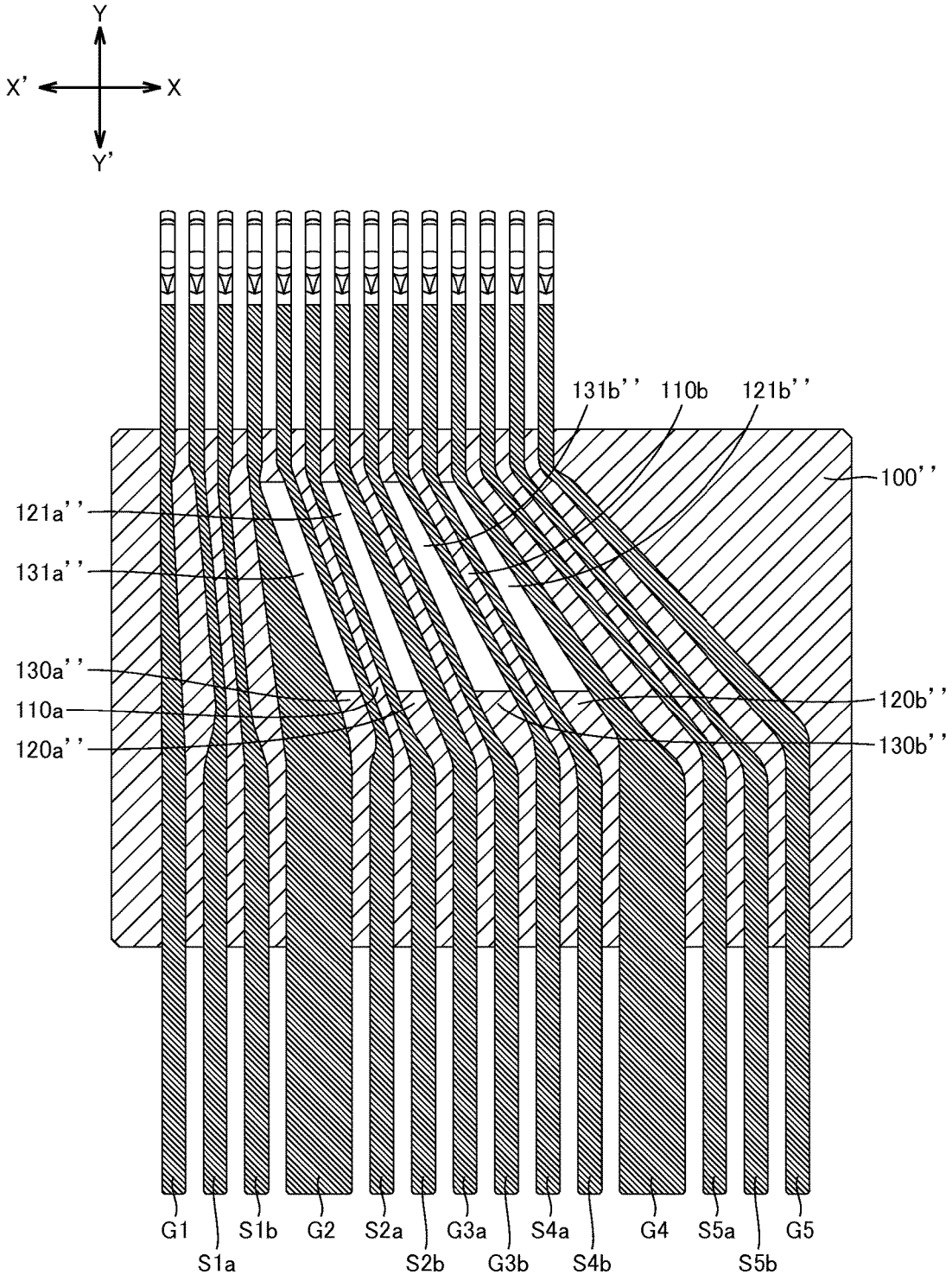
FIG. 9 is a sectional view, corresponding to FIG. 7, of a first variant of the connector in the second embodiment of the invention.

The second void of the second portion of the body of the invention may be modified in any manner as long as it is provided in at least a part of the second portion in the above embodiments and the above variants and extends from the one first terminal to the second terminal. The second void may be elongated, such as ones shown in FIG. 9. In the variant connector shown in FIG. 9, the body 100" includes second portions 120*a*" and 120*b*" having elongated second voids 121*a*" and 121*b*", respectively. Alternatively, the second portion of the body may be the second void, i.e. the second void may extend the entire area between the one first terminal and the second terminal. The second void in the above embodiments and the above variants may open to at least one of the first face and the second face of the body. This modification can improve the impedance of the insert portions of the first terminals.

The third portion of the body of the invention may be modified in any manner as long as it is provided between the other first terminal and the third terminal in the body and has at least one third void in the above embodiments and variants to be described. The third portion may be plastic material sandwiched between the terminals G1 and S1*a* in the body, between the terminals G2 and S2*a* in the body, between the terminals G3*b* and S4*a* in the body, and/or between the terminals G4 and S4*a* in the body. The width of the third portion in the above embodiments and the above variants may gradually decrease to either side of the length of the third portion. In this case, the width of the third void in the third portion also gradually decreases to either side of the length of the third portion.

Figure 10:
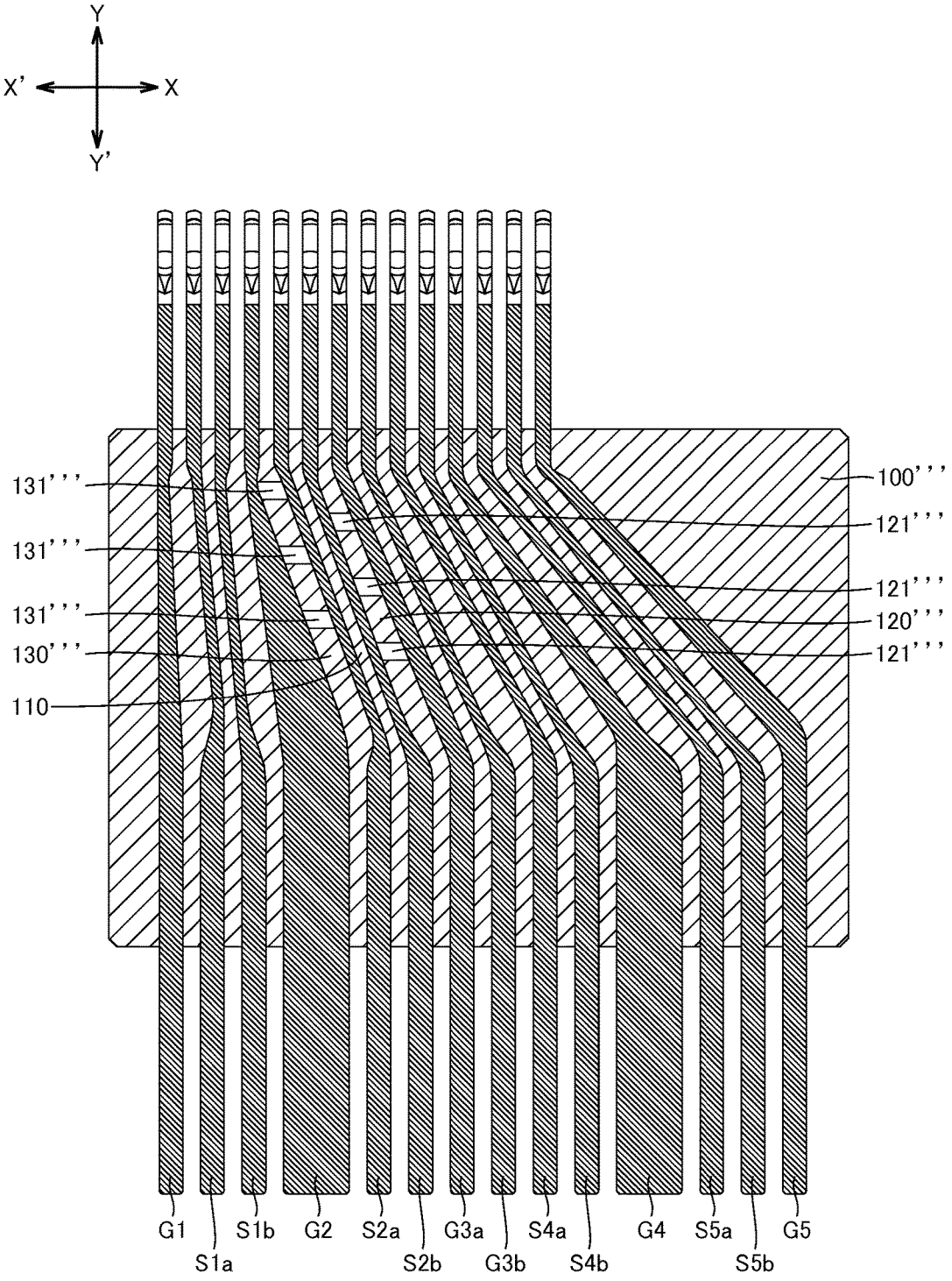
FIG. 10 is a sectional view, corresponding to FIG. 7, of a second variant of the connector in the second embodiment of the invention.

The third void of the third portion of the body of the invention may be modified in any manner as long as it is provided in at least a part of the third portion in the above embodiments and the above variants and extends from the other first terminal to the third terminal. The third void may be elongated, such as ones shown in FIG. 9. In the variant connector shown in FIG. 9, a body 100" includes third portions 130*a*" and 130*b*" having elongated third voids 131*a*" and 131*b*", respectively. The third void may also be modified as shown in FIG. 10. In another variant connector shown in FIG. 10, a body 100'" includes a second portion 120'", having a plurality of second voids 121'" and a third portion 130'", having a plurality of third voids 131'". The second voids 121'" and the third voids 131'" are in a staggered arrangement. The second void and/or the third void in the above embodiments and the above variants may open to at least one of the first face and the second face of the body. Also, the second void and/or the third void in the above embodiments and the above variants may be communicate with at least one of the first recess and the second recess in the above embodiments and variants to be described and be exposed through the one recess to the outside of the body. The second void and/or the third void may not open to the outside of the body if the body is formed using a 3D printer to be described.

The first portion of the body of the invention may be any portion between the one first terminal in the above embodiments and the above variants and the other first terminal in the above embodiments and the above variants in the body. The first portion may be plastic material sandwiched between the terminals S1*a* and S1*b* in the body, between the terminals S2*a* and S2*b* in the body, between the terminals S3*a* and S3*b* in the body, and/or between the terminals S4*a* and S4*b* in the body.

Figure 11:
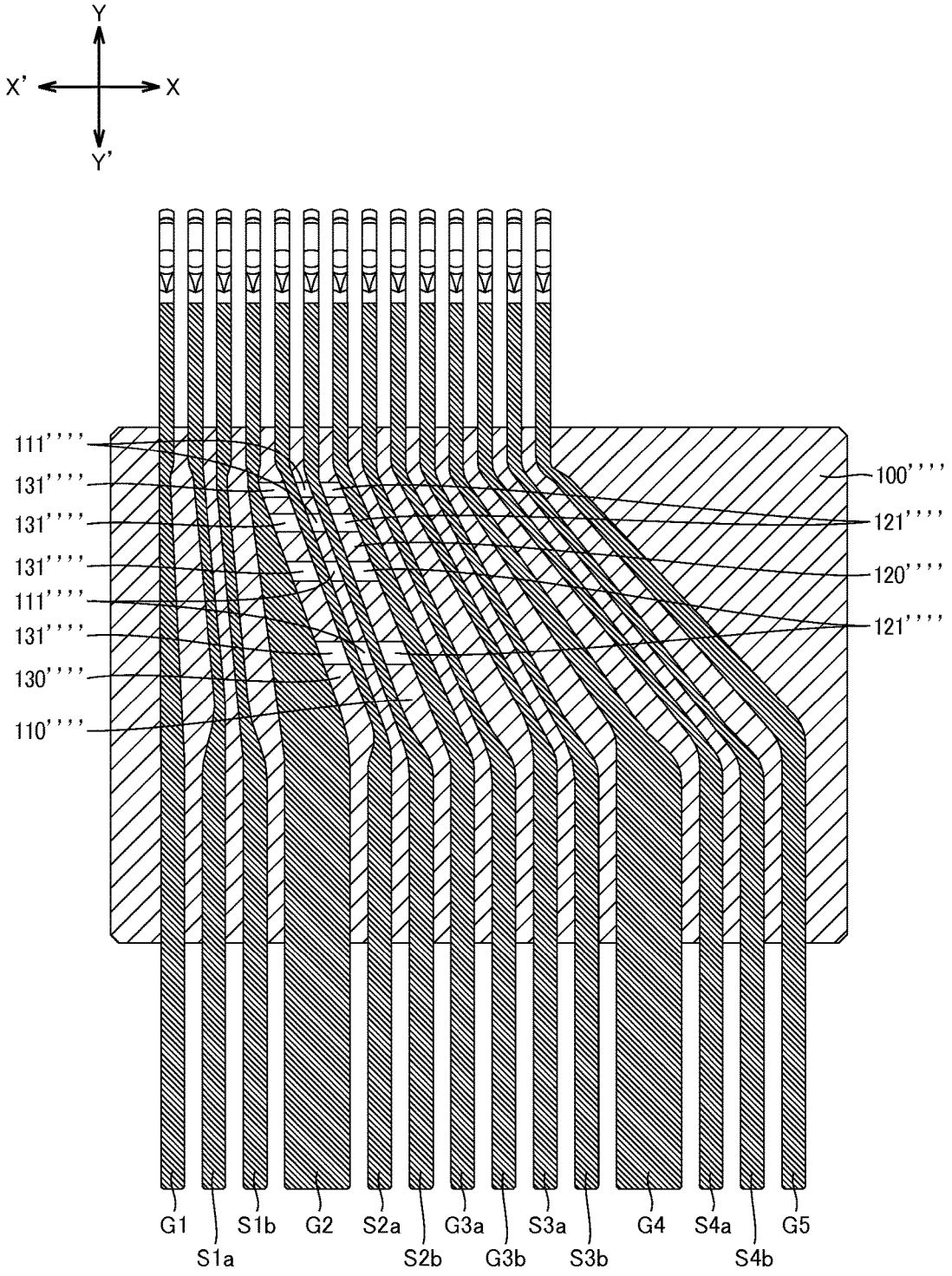
FIG. 11 is a sectional view, corresponding to FIG. 7, of a third variant of the connector in the second embodiment of the invention.

The first portion in the above embodiments and the above variants may be provided with one or more first voids, such as one as shown in FIG. 11. In the variant connector shown in FIG. 11, a body 100"" includes a first portion 110"" having a plurality of first voids 111"" in spaced relation to each other along the length direction of the first portion 110"". The first portion 110"" is a part of the body 100"" (plastic material) sandwiched between the terminal S2*a* and the terminal S2*b*. The first voids 111"" extend from the terminal S2*a* to the terminal S2*b*. The first voids 111"" may open to a first face, on one side of the third direction, or to a second face, on the other side of the third direction, of the body 100"". In the same variant connector, the terminals S2*a* and S2*b* are opposed to each other at a plurality of locations (hereinafter referred to as opposable faces) on opposite sides of the first voids 111"". The body 100"" further includes a second portion 120"" and a third portion 130"". The second portion 120"" is of similar configuration to the second portion 120' in the second embodiment and has a plurality of second voids 121"". The third portion 130"" is of similar in configuration to the third portion 130' in the second embodiment and has a plurality of third voids 131"". In this variant connector, the provision of the first voids 111"" in the first portion 110"" can further improve impedances of the terminals S2*a* and S2*b*, facilitating in matching impedances between the terminals S2*a* and S2*b*. The first portion of the invention may also be configured to be the first void, i.e. the first void may extend the entire area between the one first terminal and the other first terminal.

The first void in the above embodiments and the above variants may or may not extend from one to the other of the first terminals that sandwich the first portion. In other words, the first void may be provided at the center in the first direction of the first portion. The first void may not open to the outside of the body if the body is formed using a 3D printer to be described. The first void in the above embodiments and the above variants may be elongated such as to extend along the length direction of the first portion.

The first recess and/or the second recess of the body of the invention may be omitted. If provided, the first recess of the body of the invention may be any recess on one side of the third direction relative to at least one of the first, second, or third voids of the body in the above embodiments and the above variants such as to communicate with the at least one void and open to the first face of the body such that at least one of the terminals in the above embodiments and the above variants is partially exposed through the first recess to the outside of the body. For example, the first recess may be provided in a portion on one side of the third direction relative to the second void of the body such as to communicate with at least the second void and open to the first face of the body such that at least one of the one first terminal or the second terminal is partially exposed through the first recess to the outside of the body.

The second recess of the body of the invention, if provided, may be any recess on the other side of the third direction relative to at least one of the first, second, or third voids of the body in the above embodiments and the above variants such as to communicate with the at least one void and open to the second face of the body such that at least one of the terminals in the above embodiments and the above variants is partially exposed through the second recess to the outside of the body. For example, the second recess may be provided in a portion on the other side of the third direction relative to the second void of the body such as to communicate with at least the second void and open to the second face of the body such that at least one of the one first terminal or the second terminal is partially exposed through the second recess to the outside of the body.

The method of manufacturing the connector of the invention may be any method including (1) closing first and second molds in the above embodiments and variants to be described, (2) injecting plastic material into a cavity of the first and second molds in the above embodiments and variants to be described, and (3) thereby inserting first, second, and third terminals at least partially into the plastic material.

The closing of the first and second molds in the manufacturing method of the invention may be modified in any manner as long as the closing includes the following:

(1) housing the following terminals at least partially inside a cavity of the first and second mold:
   a) a pair of first terminals in spaced relation to each other along a first direction,
   b) a second terminal on one side of the first direction relative to and in spaced relation to one of the first terminals, and
   c) a third terminal on the other side of the first direction relative to and in spaced relation to the other first terminal;
(2) placing a second protrusion between and in contact with the one first terminal and the second terminal in the cavity, the second protrusion being provided on at least one of the first or second mold; and
(3) placing the third protrusion between and in contact with the other first terminal and the third terminal in the cavity, the third protrusion being provided on at least one of the first or second mold.

For example, the closing of the first and second molds may include housing the first, second, and third terminals partially in the cavity, with portions protruding from the cavity of the first, second, and third terminals held between the first and second molds. The closing of the first and second molds may include holding at least one of the one first terminal, the other first terminal, the second terminal, or the third terminal in the above embodiments and the above variants between the first retainer of the first mold and the second retainer of the second mold. Alternatively, the closing of the first and second molds may include holding at least one of the one first terminal, the other first terminal, the second terminal, and the third terminal in the above embodiments and the above variants between the first retainer of the first mold and the second mold. In other words, it is possible to omit only the second retainer of the second mold. Still alternatively, the closing of the first and second molds may include holding at least one of the one first terminal, the other first terminal, the second terminal, and the third terminal in the above embodiments and the above variants between the second retainer of the second mold and the first mold. In other words, it is possible to omit only the first retainer of the first mold. These holdings may include holding areas different from the areas where the second and third protrusions come into contact with the terminals.

The cavity of the first and second molds of the invention may be defined by a recess of the first mold and a recess of the second mold, by a recess of the first mold and a flat face of the second mold to close the recess, by a recess of the first mold and a projected support of the second mold to be received in the recess, by the recess of the second mold and a flat face of the first mold to close the recess, or by a recess of the second mold and a projected support of the first mold to be received in the recess.

At least one of the first or second mold of the invention includes at least one second protrusion. The second protrusion or protrusions may have any external shape and may be located anywhere in accordance with to the shape and the location of the second void or voids. The second protrusion in the above embodiments and the above variants may be provided on a recess, a flat faces, and/or a support of the first and/or second molds. Alternatively, the second protrusion in the above embodiments and the above variants may be provided on the distal face of the first retainer. In this case, the closing of the first and second molds may include holding at least one of the one first terminal and the second terminal between the first retainer and the second mold, and placing the second protrusion between and in contact with the one first terminal and the second terminal in the cavity. Still alternatively, the second protrusion in the above embodiments and the above variants may be provided on the distal face of the second retainer. In this case, the closing of the first and second molds may include holding at least one of the one first terminal and the second terminal between the second retainer and the first mold, and placing the second protrusion between and in contact with the one first terminal and the second terminal in the cavity. The second protrusion in the above embodiments and the above variants may be elongated. Further, in the case where the first and second molds are each provided with the second protrusion, the closing of the first and second molds may include placing the second protrusions between and in contact with the one first terminal and the second terminal in the cavity.

At least one of the first or second mold of the invention includes at least one third protrusion. The third protrusion or protrusions may have any external shape and may be located anywhere in accordance with to the shape and the location of the third void or voids. The third protrusion in the above embodiments and the above variants may be provided on a recess, a flat faces, and/or a support of the first and/or second molds. Alternatively, the third protrusion in the above embodiments and the above variants may be provided on the distal face of the first retainer. In this case, the closing of the first and second molds may include holding at least one of the other first terminal and the third terminal between the first retainer and the second mold and placing the third protrusion between and in contact with the other first terminal and the third terminal in the cavity. Still alternatively, the third protrusion in the above embodiments and the above variants may be provided on the distal face of the second retainer. In this case, the closing of the first and second molds may include holding at least one of the other first terminal and the third terminal between the second retainer and the first mold and placing the third protrusion between and in contact with the other first terminal and the third terminal in the cavity. The third protrusion in the above embodiments and the above variants may be elongated. Further, in the case where the first and second molds are each provided with the third protrusion, the closing of the first and second molds may include placing the third protrusions between and in contact with the other first terminal and the third terminal in the cavity. In the case where the second and third voids are disposed in a staggered arrangement as described above, the second and third protrusion should preferably be disposed in a staggered arrangement.

Figure 12:
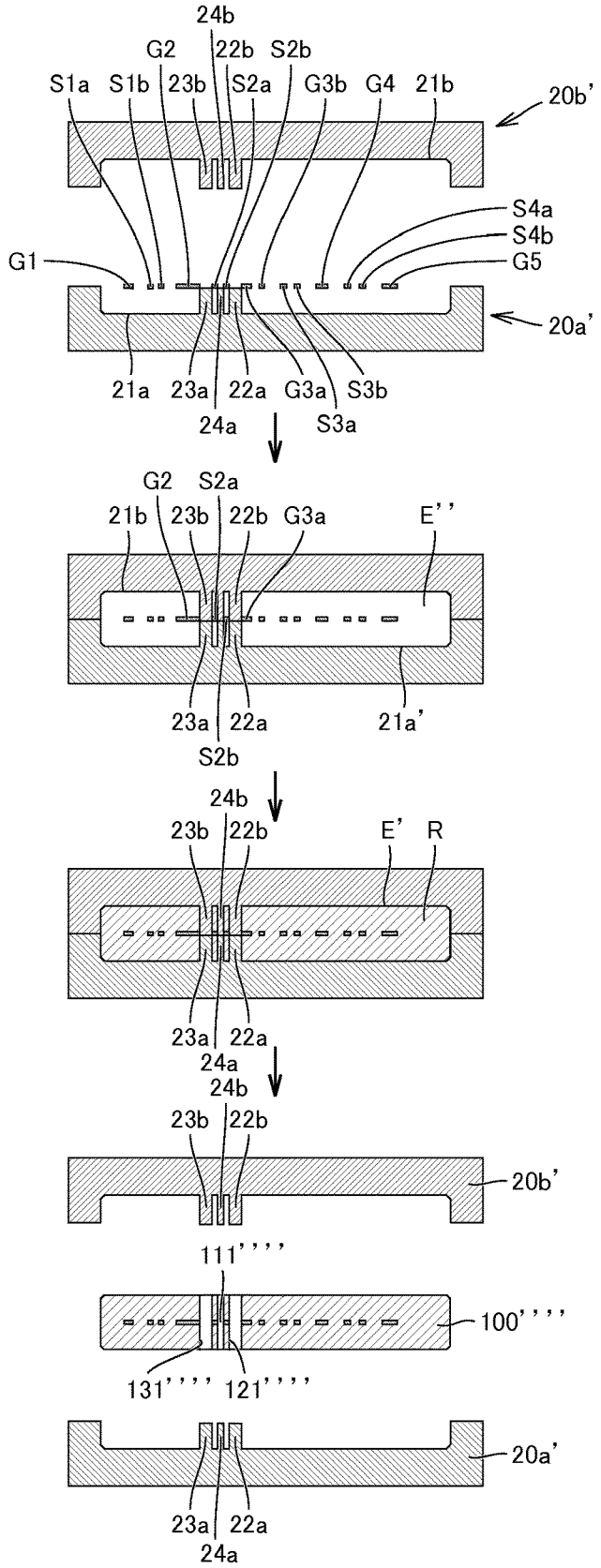
FIG. 12 is a schematic end view illustrating steps of a method of manufacturing the connector in the third variant.

In the case where the first portion of the body has a first void or voids as described above, at least one first protrusion corresponding to the first void(s) should preferably be provided on at least one of the first and second molds in the above embodiments and the above variants. The first protrusion may be provided on the first retainer, the second retainer, the bottom of a recess, the ceiling of a recess, a flat face, and/or the support in the above embodiments and the above variants. Further, the closing of the first and second molds includes placing the first protrusion between the pair of first terminals in the cavity such that the first protrusion is in contact with the pair of first terminals. More specifically, the first protrusion may be inserted between the first terminals in the cavity when closing the first and second molds as shown in FIG. 12. Alternatively, the first protrusion may be placed between the pair of first terminals when disposing the first terminals on the first mold, and this arrangement may be maintained when closing the first and second molds. As shown in FIG. 12, when closing a first mold 20*a*' and a second mold 20*b*', a first protrusion 24*b* on the second mold 20*b*' is inserted between the terminals S2*a* and S2*b* so as to contact with the opposable faces of the terminals S2*a* and S2*b*, and the first protrusion 24*b* is also brought into contact with a first protrusion 24*a* on the first mold 20*a*'. The first protrusion of the invention may be provided on a distal face of the first or second retainer in the above embodiments and the above variants. The reference numeral E" in FIG. 12 denotes a cavity of the first and second molds 20*a*' and 20*b*'.

The first and second molds of the invention may each consist of a plurality of pieces. The first, second and/or third protrusion on at least one of the first and second molds of the invention may be provided as an insert or inserts to be attached to the one mold.

The body of the invention may be formed by injection molding as described above or may be formed using a 3D printer. In the latter case, the body can be formed together with the first void, the second void, the third void, the first recess, and/or the second recess. Alternatively, the first void, the second void, the third void, the first recess, and/or the second recess may be formed by irradiating the body with a laser or the like.

Further, the connectors described above may be modified such that one of the pair of first terminals in the above embodiments and the above variants is omitted. In this case, the first terminal can be a terminal for high-speed single-ended signaling. This variant connector further includes a second and a third terminal in any of the above embodiments and the above variants, which may each be a ground terminal or low-speed signal terminal as described above. The second terminal is located on one side of the first direction relative to the first terminal, and the third terminal is located on the other side of the first direction relative to the first terminal. The body holds the first, second, and third terminals at least partially. The first portion of the body should be omitted. The second portion of the body may be located between the first terminal and the second terminal and otherwise have the same configuration as the second portion in any of the above embodiments and the above variants. The third portion of the body may be located between the first terminal and the third terminal and otherwise have the same configuration as that of the third portion in any of the above embodiments and the above variants. The variant connector with a single first terminal can also be manufactured by a manufacturing method in any of the above embodiments and the above variants, except for the step of forming the first portion.

It should be appreciated that the connectors in the embodiments and variants thereof are described above by way of examples only. The materials, shapes, dimensions, numbers, arrangements, and other configurations of the constituents of the connectors may be modified in any manner if they can perform similar functions. The configurations of the embodiments and the variants described above may be combined in any possible manner. The first direction (X-X' direction) of the invention may be any direction along which the terminals of the above embodiments or the variants are arrayed. The second direction (Y-Y' direction) of the invention may be any direction crossing the first direction. The third direction (Z-Z' direction) of the invention may be any direction crossing the first direction and the second direction.

REFERENCE SIGNS LIST

C1: connector
100: body
101: first face
102: second face
110*a*: first portion
120*a*: second portion
121*a*: second void
130*a*: third portion
131*a*: third void
110*b*: first portion
120*b*: second portion
121*b*: second void
130*b*: third portion
131*b*: third void
140: first recess
150: second recess
200: terminal group
S1*a*, S1*b*: terminal
S1*a*1, S1*b*1: contact portion
S1*a*2, S1*b*2: connecting portion
S1*a*3, S1*b*3: middle portion
S2*a*, S2*b*: terminal (first terminal)
S2*a*1, S2*b*1: contact portion
S2*a*2, S2*b*2: connecting portion
S2*a*3, S2*b*3: middle portion
S3*a*, S3*b*: terminal (first terminal)
S3*a*1, S3*b*1: contact portion
S3*a*2, S3*b*2: connecting portion
S3*a*3, S3*b*3: middle portion
S4*a*, S4*b*: terminal
S4*a*1, S4*b*1: contact portion
S4*a*2, S4*b*2: connecting portion
S4*a*3, S4*b*3: middle portion
G1: terminal
G11: contact portion
G12: connecting portion
G13: middle portion
G2: terminal (third terminal)
G21: contact portion
G22: connecting portion
G23: middle portion
G3*a*, G3*b*: terminal (second terminal, third terminal)
G3*a*1, G3*b*1: contact portion
G3*a*2, G3*b*2: connecting portion
G3*a*3, G3*b*3: middle portion
G4: terminal (second terminal)
G41: contact portion
G42: connecting portion
G43: middle portion
G5: terminal
G51: contact portion
G52: connecting portion
G53: middle portion
10*a*, 10*b*: first mold, second mold
11*a*, 11*b*: recess
E: cavity
12*b*: first retainer
13*b*: protrusion (second protrusion)
14*b*: protrusion (third protrusion)
15*b*: protrusion (second protrusion)
16*b*: protrusion (third protrusion)

The invention claimed is:

1. A connector comprising:

a pair of first terminals being differential signal terminals in spaced juxtaposition to each other in a first direction such as to extend in a direction including a component of a second direction, the second direction crossing the first direction, the first terminals including one first terminal and the other first terminal;

a second terminal being a terminal not serving as a differential signal terminal, the second terminal extending in a direction including a component of the second direction such as to be located on one side in the first direction relative to and in spaced relation to the one first terminal;

a third terminal being a terminal not serving as a differential signal terminal, the third terminal extending in a direction including a component of the second direction such as to be located on the other side in the first direction relative to and in spaced relation to the other first terminal; and a body of an insulating plastic material, the body holding the first, second, and third terminals at least partially and including:

a first portion between the first terminals, the first portion being comprised of a part of the insulating plastic material of the body;

a second portion between the one first terminal and the second terminal, the second portion having a second void in at least a portion thereof, the second void extending from the one first terminal to the second terminal; and a third portion between the other first terminal and the third terminal, the third portion having a third void in at least a portion thereof, the third void extending from the other first terminal to the third terminal, wherein the first portion of the body is located between the second void and the third void.

2. The connector according to claim 1, wherein the body further includes:

a first face on one side of a third direction, the third direction crossing the first direction and the second direction; and a second face on the other side of the third direction, and at least one of the second void or the third void opens to at least one of the first face or the second face.

3. The connector according to claim 1, wherein the body further includes:

a first face on one side of a third direction, the third direction crossing the first direction and the second direction; and a first recess on the one side of the third direction relative to the second void of the body, the first recess communicating at least with the second void and opening to the first face such that at least one of the one first terminal or the second terminal is partially exposed through the first recess to the outside of the body.

4. The connector according to claim 1, wherein the second void comprises a plurality of second voids spaced from each other along a length direction of the second portion, and the third void comprises a plurality of the third voids spaced from each other along a length direction of the third portion.

5. The connector according to claim 4, wherein the second voids and the third voids are in a staggered arrangement.

6. The connector according to claim 1, wherein the second void is elongated such as to extend along the length direction of the second portion.

7. The connector according to claim 1, wherein the third void is elongated such as to extend along the length direction of the second portion.

8. The connector according to claim 1, wherein the body further includes:

a first face on one side of a third direction, the third direction crossing the first direction and the second direction; and a first recess on the one side of the third direction relative to the first portion, the second void, and the third void of the body, the first recess communicating with the second and third voids and opening to the first face such that the first to third terminals and the first portion of the body are partially exposed through the first recess to the outside of the body.

9. A connector comprising:

a pair of first terminals being differential signal terminals in spaced juxtaposition to each other in a first direction such as to extend in a direction including a component of a second direction, the second direction crossing the first direction, the first terminals including one first terminal and the other first terminal;

a second terminal being a terminal not serving as a differential signal terminal, the second terminal extending in a direction including a component of the second direction such as to be located on one side in the first direction relative to and in spaced relation to the one first terminal;

a third terminal being a terminal not serving as a differential signal terminal, the third terminal extending in a direction including a component of the second direction such as to be located on the other side in the first direction relative to and in spaced relation to the other first terminal; and a body of an insulating plastic material, the body holding the first, second, and third terminals at least partially and including:

a first portion between the first terminals;

a second portion between the one first terminal and the second terminal, the second portion having a second void in at least a portion thereof, the second void extending from the one first terminal to the second terminal; and a third portion between the other first terminal and the third terminal, the third portion having a third void in at least a portion thereof, the third void extending from the other first terminal to the third terminal, wherein the body further includes:

a first face on one side of a third direction, the third direction crossing the first direction and the second direction;

a second face on the other side of the third direction;

a first recess on the one side of the third direction relative to the second void of the body, the first recess communicating at least with the second void and opening to the first face such that at least one of the one first terminal or the second terminal is partially exposed through the first recess to the outside of the body; and a second recess on the other side of the third direction relative to the second void of the body, the second recess communicating at least with the second void and opening to the second face such that at least one of the one first terminal or the second terminal is partially exposed through the second recess to the outside of the body.

10. The connector according to claim 9, wherein the first portion has a first void in at least a portion thereof.

* * * * *